US006739485B2

(12) United States Patent
Sample et al.

(10) Patent No.: US 6,739,485 B2
(45) Date of Patent: May 25, 2004

(54) DUAL ACTION VALVE FOR MOLTEN METAL APPLICATIONS

(75) Inventors: Vivek M. Sample, Murrysville, PA (US); Domenic A. Ghiardi, Avonmore, PA (US); Mark A. Newborn, Export, PA (US); Ronald G. Chabal, New Kensington, PA (US); Vincent A. Paola, Jeannette, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/628,625

(22) Filed: Jul. 28, 2003

(65) Prior Publication Data

US 2004/0017029 A1 Jan. 29, 2004

Related U.S. Application Data

(63) Continuation-in-part of application No. 10/127,160, filed on Apr. 19, 2002, which is a continuation-in-part of application No. 10/014,649, filed on Dec. 11, 2001, now Pat. No. 6,536,508.

(51) Int. Cl.[7] ..... B22D 11/10

(52) U.S. Cl. ..... 222/594; 222/596; 164/437

(58) Field of Search ..... 222/590, 594, 222/596; 164/488, 437, 490, 113, 312

(56) References Cited

U.S. PATENT DOCUMENTS

| | | | | |
|---|---|---|---|---|
| 1,587,933 | A | | 6/1926 | Barme |
| 1,850,668 | A | | 3/1932 | Harris |
| 1,924,294 | A | | 8/1933 | Shirk et al. |
| 3,103,713 | A | | 9/1963 | Ahlgren |
| 3,224,240 | A | | 12/1965 | Müller |
| 3,328,994 | A | | 7/1967 | Lindemann |
| 3,574,341 | A | * | 4/1971 | Fehling et al. ..... 251/319 |
| 3,625,045 | A | | 12/1971 | Riemann |
| 3,861,848 | A | | 1/1975 | Weingarten |
| RE28,795 | E | | 5/1976 | Fuchs, Jr. |
| 4,044,587 | A | | 8/1977 | Green et al. |
| 4,054,048 | A | | 10/1977 | Hagerman |
| 4,075,881 | A | | 2/1978 | Kreidler |
| 4,393,917 | A | | 7/1983 | Fuchs, Jr. |
| 4,425,775 | A | | 1/1984 | Fuchs, Jr. |
| 4,601,325 | A | | 7/1986 | Maddock |
| 4,718,476 | A | | 1/1988 | Eibe |
| 4,730,935 | A | | 3/1988 | Kolossow |
| 4,774,997 | A | | 10/1988 | Eibe |
| 4,793,596 | A | | 12/1988 | Kubota et al. |
| 5,015,438 | A | | 5/1991 | Ashok et al. |
| 5,015,439 | A | | 5/1991 | Tyler et al. |
| 5,152,163 | A | | 10/1992 | Hawkes et al. |
| 5,157,955 | A | | 10/1992 | Hawkes et al. |
| 5,377,744 | A | | 1/1995 | Maddock |
| 5,383,347 | A | | 1/1995 | Riviere et al. |
| 5,407,000 | A | | 4/1995 | Mercer, II et al. |
| 5,443,187 | A | | 8/1995 | Samuelson |
| 5,494,262 | A | | 2/1996 | McLane et al. |
| 5,568,766 | A | | 10/1996 | Otremba et al. |
| 5,595,085 | A | | 1/1997 | Chen |
| 5,598,731 | A | | 2/1997 | Riviere, V. et al. |
| 5,850,870 | A | * | 12/1998 | Wagstaff et al. ..... 164/450.1 |
| 6,505,674 | B1 | * | 1/2003 | Sample et al. ..... 222/594 |
| 6,536,508 | B1 | * | 3/2003 | Sample et al. ..... 222/590 |

* cited by examiner

*Primary Examiner*—Scott Kastler
(74) *Attorney, Agent, or Firm*—Daniel C. Aboles

(57) ABSTRACT

A molten metal supply system (90) includes a plurality of injectors (100) each having an injector housing (102) and a reciprocating piston (104). A molten metal supply source (132) is in fluid communication with the housing (102) of each of the injectors (100). The piston (104) is movable through a first stroke allowing molten metal (134) to be received into the housing (102) from the molten metal supply source (132), and a second stroke for displacing the molten metal (134) from the housing (102). A pressurized gas supply source (144) is in fluid communication with the housing (102) of each of the injectors (100) through respective gas control valves (146). The injectors (100) each include an intake/injection port (138) in the form of a dual action valve (500) adapted to admit and dispense molten metal from the injectors (100).

40 Claims, 17 Drawing Sheets

DUAL ACTION VALVE FOR MOLTEN METAL APPLICATIONS

CROSS REFERENCE TO RELATED APPLICATIONS

This application is a continuation-in-part of U.S. application Ser. No. 10/127,160 entitled "Continuous Pressure Molten Metal Supply System and Method For Forming Continuous Metal Articles" filed Apr. 19, 2002 which is a continuation-in-part of U.S. application Ser. No. 10/014,649 entitled "Continuous Pressure Molten Metal Supply System and Method" filed Dec. 11, 2001, now U.S. Pat. No. 6,536,508.

BACKGROUND OF THE INVENTION

1. Field of the Invention

The present invention relates to a molten metal supply system and, more particularly, a continuous pressure molten metal supply system and method for forming continuous metal articles of indefinite length, and further to a dual action valve suitable for use in molten metal applications generally and the continuous pressure molten metal supply system in particular.

2. Description of the Prior Art

The metal working process known as extrusion involves pressing metal stock (ingot or billet) through a die opening having a predetermined configuration in order to form a shape having a longer length and a substantially constant cross-section. For example, in the extrusion of aluminum alloys, the aluminum stock is preheated to the proper extrusion temperature. The aluminum stock is then placed into a heated cylinder. The cylinder utilized in the extrusion process has a die opening at one end of the desired shape and a reciprocal piston or ram having approximately the same cross-sectional dimensions as the bore of the cylinder. This piston or ram moves against the aluminum stock to compress the aluminum stock. The opening in the die is the path of least resistance for the aluminum stock under pressure. The aluminum stock deforms and flows through the die opening to produce an extruded product having the same cross-sectional shape as the die opening.

Referring to FIG. 1, the foregoing described extrusion process is identified by reference numeral 10, and typically consists of several discreet and discontinuous operations including: melting 20, casting 30, homogenizing 40, optionally sawing 50, reheating 60, and finally, extrusion 70. The aluminum stock is cast at an elevated temperature and typically cooled to room temperature. Because the aluminum stock is cast, there is a certain amount of inhomogeneity in the structure and the aluminum stock is heated to homogenize the cast metal. Following the homogenization step, the aluminum stock is cooled to room temperature. After cooling, the homogenized aluminum stock is reheated in a furnace to an elevated temperature called the preheat temperature. Those skilled in the art will appreciate that the preheat temperature is generally the same for each billet that is to be extruded in a series of billets and is based on experience. After the aluminum stock has reached the preheat temperature, it is ready to be placed in an extrusion press and extruded.

All of the foregoing steps relate to practices that are well known to those skilled in the art of casting and extruding. Each of the foregoing steps is related to metallurgical control of the metal to be extruded. These steps are very cost intensive, with energy costs incurring each time the metal stock is reheated from room temperature. There are also in-process recovery costs associated with the need to trim the metal stock, labor costs associated with process inventory, and capital and operational costs for the extrusion equipment.

Attempts have been made in the prior art to design an extrusion apparatus that will operate directly with molten metal. U.S. Pat. No. 3,328,994 to Lindemann discloses one such example. The Lindemann patent discloses an apparatus for extruding metal through an extrusion nozzle to form a solid rod. The apparatus includes a container for containing a supply of molten metal and an extrusion die (i.e., extrusion nozzle) located at the outlet of the container. A conduit leads from a bottom opening of the container to the extrusion nozzle. A heated chamber is located in the conduit leading from the bottom opening of the container to the extrusion nozzle and is used to heat the molten metal passing to the extrusion nozzle. A cooling chamber surrounds the extrusion nozzle to cool and solidify the molten metal as it passes therethrough. The container is pressurized to force the molten metal contained in the container through the outlet conduit, heated chamber and ultimately, the extrusion nozzle.

U.S. Pat. No. 4,075,881 to Kreidler discloses a method and device for making rods, tubes, and profiled articles directly from molten metal by extrusion through use of a forming tool and die. The molten metal is charged into a receiving compartment of the device in successive batches that are cooled so as to be transformed into a thermal-plastic condition. The successive batches build up layer-by-layer to form a bar or other similar article.

U.S. Pat. Nos. 4,774,997 and 4,718,476, both to Eibe, disclose an apparatus and method for continuous extrusion casting of molten metal. In the apparatus disclosed by the Eibe patents, molten metal is contained in a pressure vessel that may be pressurized with air or an inert gas such as argon. When the pressure vessel is pressurized, the molten metal contained therein is forced through an extrusion die assembly. The extrusion die assembly includes a mold that is in fluid communication with a downstream sizing die. Spray nozzles are positioned to spray water on the outside of the mold to cool and solidify the molten metal passing therethrough. The cooled and solidified metal is then forced through the sizing die. Upon exiting the sizing die, the extruded metal in the form of a metal strip is passed between a pair of pinch rolls and further cooled before being wound on a coiler.

A primary object of the present invention is to provide a dual action valve suitable for use in molten metal applications generally and for use, in particular, in a molten metal supply system and method capable of forming continuous metal articles of indefinite lengths as described herein.

SUMMARY OF THE INVENTION

The above object is generally accomplished by a dual action valve for molten metal applications, which may be used, for example, as part of a molten metal supply system as set forth in this disclosure. The dual action valve generally comprises a housing defining an inlet opening, a valve body disposed within the housing, an inlet float member, and an outlet float assembly. The valve body defines an inlet conduit in fluid communication with the inlet opening for receiving molten metal into the valve body and an outlet conduit for dispensing molten metal from the valve body. The inlet float member is disposed in the inlet conduit and movable with molten metal flow into the valve body to open the inlet conduit. The inlet float member is adapted to close the inlet conduit upon termination of molten metal flow into the valve body. The outlet float assembly is disposed in the outlet conduit and movable with molten metal flow in the outlet conduit to permit molten metal outflow from the valve body and prevent reverse molten metal flow in the outlet conduit.

The dual action valve may further include an inlet seat liner disposed in the inlet conduit. The inlet float member preferably coacts with the inlet seat liner to close the inlet conduit upon termination of molten metal flow into the valve body. The inlet seat liner may comprise a tapered outer surface cooperating with a tapered recessed portion of the inlet conduit.

The inlet float member may have a greater density than the molten metal admitted to the valve body, such that the inlet float member closes the inlet conduit under the force of gravity upon termination of molten metal flow into the valve body. The inlet float member may be spherical shaped.

The outlet float assembly may comprise a carrier member and an outlet float member support by the carrier member. The outlet float member may have a lower density than the molten metal admitted to the valve body, such that the outlet float member is buoyed up from the carrier member to close the outlet conduit if reverse molten metal flow occurs in the outlet conduit. Additionally, the carrier member and outlet float member may have a combined density lower than the molten metal admitted to the valve body, such that the carrier member and outlet float member are buoyed up together to close the outlet conduit if reverse molten metal flow occurs in the outlet conduit. Further, the carrier member and outlet float member may be formed integrally as a one-piece unit.

The outlet float member may be spherical shaped. The outlet float member may be removably supported by the carrier member. For example, the outlet float member may be removably received in a cup-shaped recess defined in the carrier member. The outlet float member and the cup-shaped recess may have mating spherical shapes.

The outlet conduit may define an outlet chamber, and the carrier member and outlet float member may be disposed in the outlet chamber. The carrier member may define a central passage in fluid communication with the outlet chamber for passage of molten metal through the outlet chamber. The carrier member may further define a plurality of branch conduits connecting the central passage to the outlet chamber. The carrier member may further define a pressure seal port connecting the cup-shaped recess and central passage for molten metal fluid communication therebetween.

An outlet seat liner may be disposed in the outlet conduit immediately upstream of the outlet chamber. The outlet float member may coact with the outlet seat liner to close the outlet conduit upon reverse molten metal flow in the outlet chamber. The outlet seat liner may comprise a tapered outer surface cooperating with a tapered recessed portion of the outlet conduit.

Top and bottom ends of the housing may be provided with circumferential seal grooves for creating seals with molten metal flow conduits to be connected to the top and bottom ends of the housing.

Additionally, the dual action valve may further comprise a spring member disposed in the inlet conduit downstream upstream of the inlet float member. The spring member may be adapted to coact with the inlet float member to assist in closing the inlet conduit upon termination of molten metal flow into the valve body. The outlet float assembly may further comprise a second spring member adapted to coact with the carrier member to assist in closing the outlet conduit if reverse molten metal flow occurs in the outlet conduit. Only one spring member provided in the inlet or outlet conduit wherein either the inlet float member or the outlet float assembly is working against the force of gravity is preferably required in the dual action valve in accordance with the present invention, as discussed further herein.

Further details and advantages of the present invention will become apparent from the following detailed description when read in conjunction with the drawings, wherein like parts are designated with like reference numerals.

DETAILED DESCRIPTION OF THE PREFERRED EMBODIMENTS

The present invention is directed to a molten metal supply system incorporating at least two (i.e., a plurality of) molten metal injectors. The molten metal supply system may be used to deliver molten metal to a downstream metal working or metal forming apparatus or process. In particular, the molten metal supply system is used to provide molten metal at substantially constant flow rates and pressures to such downstream metal working or forming processes as extrusion, forging, and rolling. Other equivalent downstream processes are within the scope of the present invention.

Figure 2:
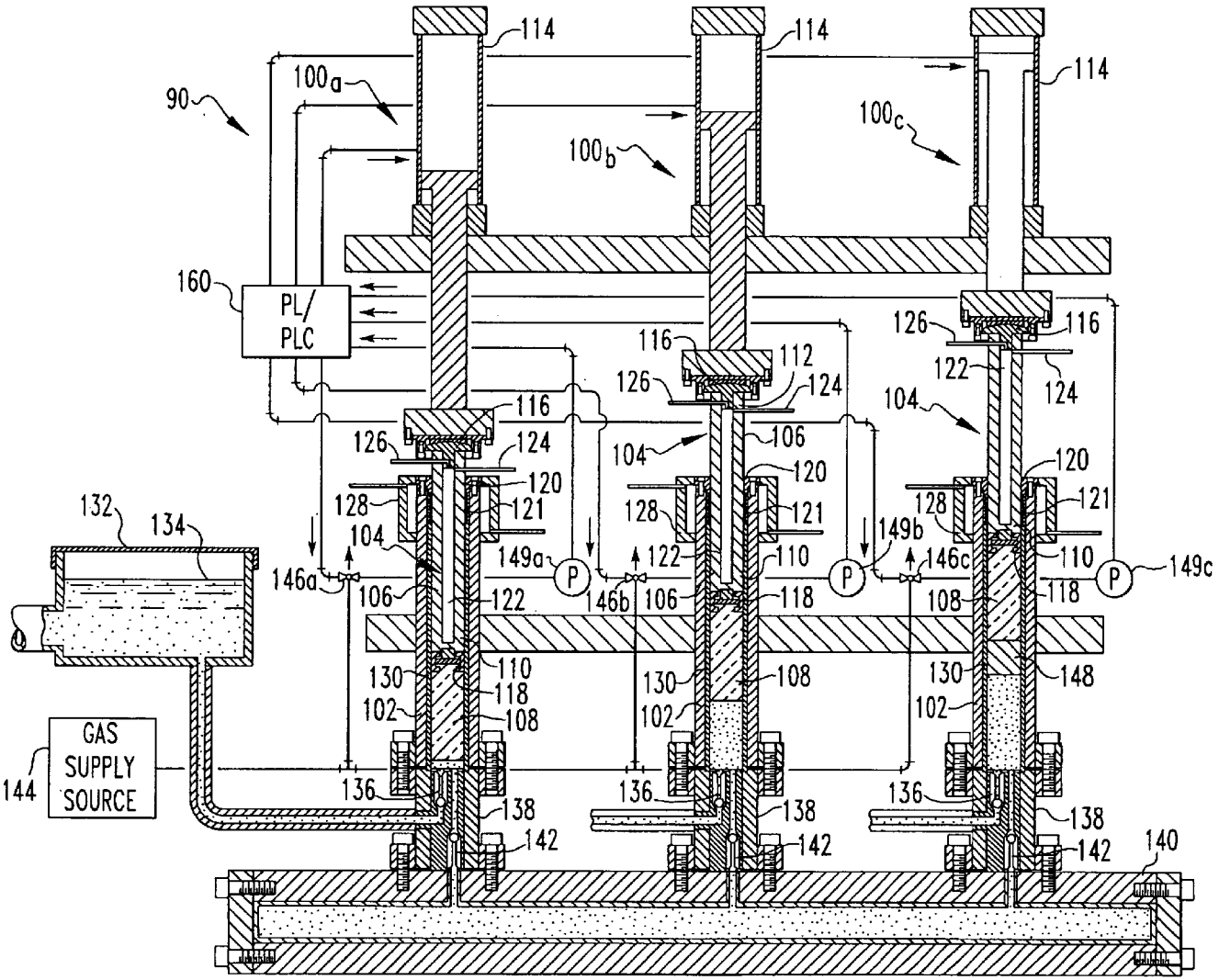
FIG. 2 is a cross-sectional view of a molten metal supply system including a molten metal supply source, a plurality of molten metal injectors, and an outlet manifold according to a first embodiment of the present invention.
Figure 3:
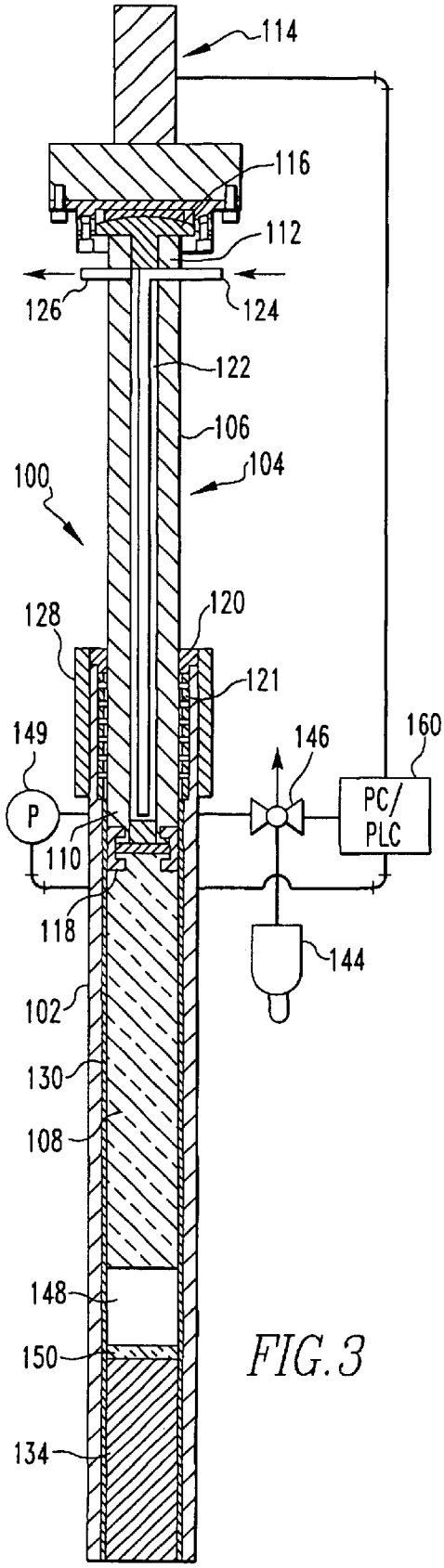
FIG. 3 is a cross-sectional view of one of the injectors of the molten metal supply system of FIG. 2 showing the injector at the beginning of a displacement stroke.
Figure 4:
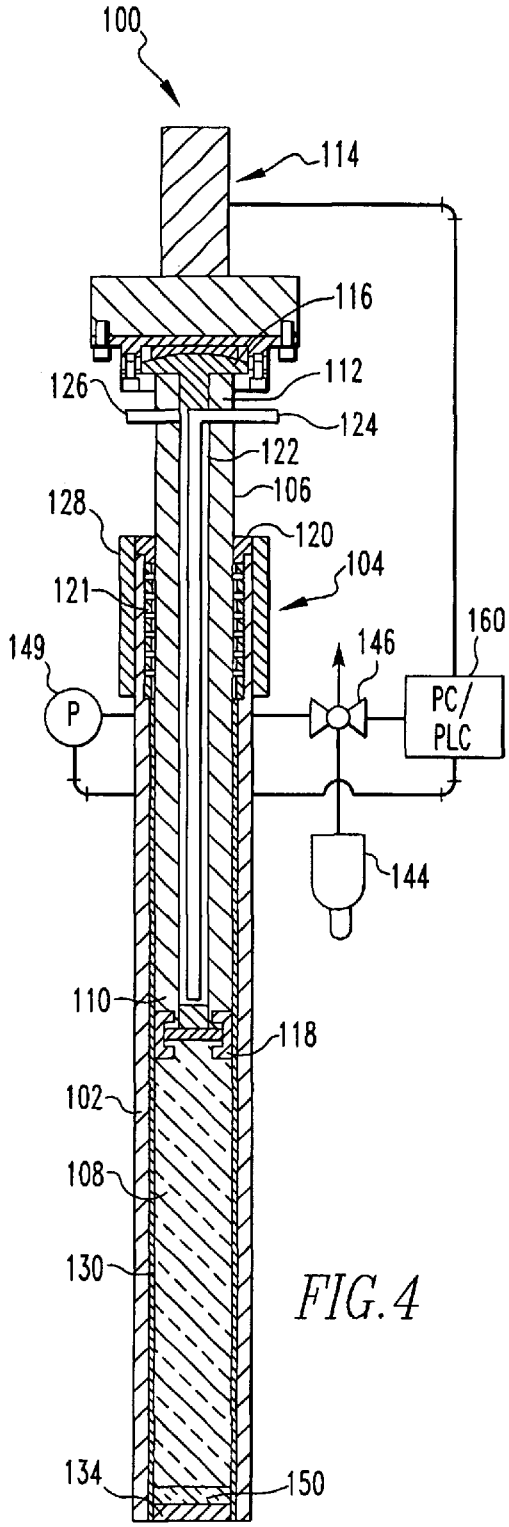
FIG. 4 is a cross-sectional view of the injector of FIG. 3 showing the injector at the beginning of a return stroke.

Referring to FIGS. 2–4, a molten metal supply system 90 in accordance with the present invention includes a plurality of molten metal injectors 100 separately identified with "a", "b", and "c" designations for clarity. The three molten metal injectors 100*a*, 100*b*, 100*c* shown in FIG. 2 are an exemplary illustration of the present invention and the minimum number of injectors 100 required for the molten metal supply system 90 is two as indicated previously. The injectors 100*a*, 100*b*, 100*c* are identical and their component parts are described hereinafter in terms of a single injector "100" for clarity.

The injector 100 includes a housing 102 that is used to contain molten metal prior to injection to a downstream apparatus or process. A piston 104 extends downward into the housing 102 and is reciprocally operable within the housing 102. The housing 102 and piston 104 are preferably cylindrically shaped. The piston 104 includes a piston rod 106 and a pistonhead 108 connected to the piston rod 106. The piston rod 106 has a first end 110 and a second end 112. The pistonhead 108 is connected to the first end 110 of the piston rod 106. The second end 112 of the piston rod 106 is coupled to a hydraulic actuator or ram 114 for driving the piston 104 through its reciprocal movement. The second end 112 of the piston rod 106 is coupled to the hydraulic actuator 114 by a self-aligning coupling 116. The pistonhead 108 preferably remains located entirely within the housing 102 throughout the reciprocal movement of the piston 104. The pistonhead 108 may be formed integrally with the piston rod 106 or separately therefrom.

The first end 110 of the piston rod 106 is connected to the pistonhead 108 by a thermal insulation barrier 118, which may be made of zirconia or a similar material. An annular pressure seal 120 is positioned about the piston rod 106 and includes a portion 121 extending within the housing 102. The annular pressure seal 120 provides a substantially gas tight seal between the piston rod 106 and housing 102.

Due to the high temperatures of the molten metal with which the injector 100 is used, the injector 100 is preferably cooled with a cooling medium, such as water. For example, the piston rod 106 may define a central bore 122. The central bore 122 is in fluid communication with a cooling water source (not shown) through an inlet conduit 124 and an outlet conduit 126, which pass cooling water through the interior of the piston rod 106. Similarly, the annular pressure seal 120 may be cooled by a cooling water jacket 128 that extends around the housing 102 and is located substantially coincident with the pressure seal 120. The injectors 100*a*, 100*b*, 100*c* may be commonly connected to a single cooling water source.

The injectors 100*a*, 100*b*, 100*c*, according to the present invention, are preferably suitable for use with molten metals having a low melting point such as aluminum, magnesium, copper, bronze, alloys including the foregoing metals, and other similar metals. The present invention further envisions that the injectors 100*a*, 100*b*, 100*c* may be used with ferrous-containing metals as well, alone or in combination with the above-listed metals. Accordingly, the housing 102, piston rod 106, and pistonhead 108 for each of the injectors 100*a*, 100*b*, 100*c* are made of high temperature resistant metal alloys that are suitable for use with molten aluminum and molten aluminum alloys, and the other metals and metal alloys identified hereinabove. The pistonhead 108 may also be made of refractory material or graphite. The housing 102 has a liner 130 on its interior surface. The liner 130 may be made of refractory material, graphite, or other materials suitable for use with molten aluminum, molten aluminum alloys, or any of the other metals or metal alloys identified previously.

The piston 104 is generally movable through a return stroke in which molten metal is received into the housing 102 and a displacement stroke for displacing the molten metal from the housing 102. FIG. 3 shows the piston 104 at a point just before it begins a displacement stroke (or at the end of a return stroke) to displace molten metal from the housing 102. FIG. 4, conversely, shows the piston 104 at the end of a displacement stroke (or at the beginning of a return stroke).

The molten metal supply system 90 further includes a molten metal supply source 132 to maintain a steady supply of molten metal 134 to the housing 102 of each of the injectors 100*a*, 100*b*, 100*c*. The molten metal supply source 132 may contain any of the metals or metal alloys discussed previously.

The injector 100 further includes a first valve 136. The injector 100 is in fluid communication with the molten metal supply source 132 through the first valve 136. In particular, the housing 102 of the injector 100 is in fluid communication with the molten metal supply source 132 through the first valve 136, which is preferably a check valve for preventing backflow of molten metal 134 to the molten metal supply source 132 during the displacement stroke of the piston 104. Thus, the first check valve 136 permits inflow of molten metal 134 to the housing 102 during the return stroke of the piston 104.

The injector 100 further includes an intake/injection port 138. The first check valve 136 is preferably located in the intake/injection port 138 (hereinafter "port 138"), which is connected to the lower end of the housing 102. The port 138 may be fixedly connected to the lower end of the housing 102 by any means customary in the art, or formed integrally with the housing.

The molten metal supply system 90 further includes an outlet manifold 140 for supplying molten metal 134 to a downstream apparatus or process. The injectors 100*a*, 100*b*, 100*c* are each in fluid communication with the outlet manifold 140. In particular, the port 138 of each of the injectors 100*a*, 100*b*, 100*c* is used as the inlet or intake into each of the injectors 100*a*, 100*b*, 100*c*, and further used to distribute (i.e., inject) the molten metal 134 displaced from the housing 102 of each of the injectors 100*a*, 100*b*, 100*c* to the outlet manifold 140.

The injector 100 further includes a second check valve 142, which is preferably located in the port 138. The second check valve 142 is similar to the first check valve 136, but is now configured to provide an outlet conduit for the molten metal 134 received into the housing 102 of the injector 100 to be displaced from the housing 102 and into the outlet manifold 140 and the ultimate downstream process.

The molten metal supply system 90 further includes a pressurized gas supply source 144 in fluid communication with each of the injectors 100*a*, 100*b*, 100*c*. The gas supply source 144 may be a source of inert gas, such as helium, nitrogen, or argon, a compressed air source, or carbon dioxide. In particular, the housing 102 of each of the injectors 100*a*, 100*b*, 100*c* is in fluid communication with the gas supply source 144 through respective gas control valves 146*a*, 146*b*, 146*c*.

The gas supply source 144 is preferably a common source that is connected to the housing 102 of each of the injectors 100*a*, 100*b*, 100*c*. The gas supply source 144 is provided to pressurize a space that is formed between the pistonhead 108 and the molten metal 134 flowing into the housing 102 during the return stroke of the piston 104 of each of the injectors 100*a*, 100*b*, 100*c*, as discussed more fully hereinafter. The space between the pistonhead 108 and molten metal 134 is formed during the reciprocal movement of the piston 104 within the housing 102, and is identified in FIG. 3 with reference numeral 148 for the exemplary injector 100 shown in FIG. 3.

In order for gas from the gas supply source 144 to flow to the space 148 formed between the pistonhead 108 and molten metal 134, the pistonhead 108 has a slightly smaller outer diameter than the inner diameter of the housing 102. Accordingly, there is very little to no wear between the pistonhead 108 and housing 102 during operation of the injectors 100*a*, 100*b*, 100*c*. The gas control valves 146*a*, 146*b*, 146*c* are configured to pressurize the space 148 formed between the pistonhead 108 and molten metal 134 as well as vent the space 148 to atmospheric pressure at the end of each displacement stroke of the piston 104. For example, the gas control valves 146*a*, 146*b*, 146*c* each have a singular valve body with two separately controlled ports, one for "venting" the space 148 and the second for "pressurizing" the space 148 as discussed herein. The separate vent and pressurization ports may be actuated by a single multi-position device, which is remotely controlled. Alternatively, the gas control valves 146*a*, 146*b*, 146*c* may be replaced in each case by two separately controlled valves, such as a vent valve and a gas supply valve, as discussed herein in connection with FIG. 6. Either configuration is preferred.

The molten metal supply system 90 further includes respective pressure transducers 149*a*, 149*b*, 149*c* connected to the housing 102 of each of the injectors 100*a*, 100*b*, 100*c* and used to monitor the pressure in the space 148 during operation of the injectors 100*a*, 100*b*, 100*c*.

The injector 100 optionally further includes a floating thermal insulation barrier 150 located in the space 148 to separate the pistonhead 108 from direct contact with the molten metal 134 received in the housing 102 during the reciprocal movement of the piston 104. The insulation barrier 150 floats within the housing 102 during operation of the injector 100, but generally remains in contact with the molten metal 134 received into the housing 102. The insulation barrier 150 may be made of, for example, graphite or an equivalent material suitable for use with molten aluminum or aluminum alloys.

The molten metal supply system 90 further includes a control unit 160, such as a programmable computer (PC) or a programmable logic controller (PLC), for individually controlling the injectors 100*a*, 100*b*, 100*c*. The control unit 160 is provided to control the operation of the injectors 100*a*, 100*b*, 100*c* and, in particular, to control the movement of the piston 104 of each of the injectors 100*a*, 100*b*, 100*c*, as well as the operation of the gas control valves 146*a*, 146*b*, 146*c*, whether provided in a single valve or multiple valve form. Consequently, the individual injection cycles of the injectors 100*a*, 100*b*, 100*c* may be controlled within the molten metal supply system 90, as discussed further herein.

The "central" control unit 160 is connected to the hydraulic actuator 114 of each of the injectors 100*a*, 100*b*, 100*c* and to the gas control valves 146*a*, 146*b*, 146*c* to control the sequencing and operation of the hydraulic actuator 114 of each of the injectors 100*a*, 100*b*, 100*c* and the operation of the gas control valves 146*a*, 146*b*, 146*c*. The pressure transducers 149*a*, 149*b*, 149*c* connected to the housing 102 of each of the injectors 100*a*, 100*b*, 100*c* are used to provide respective input signals to the control unit 160. In general, the control unit 160 is utilized to activate the hydraulic actuator 114 controlling the movement of the piston 104 of each of the injectors 100*a*, 100*b*, 100*c* and the operation of the respective gas control valves 146*a*, 146*b*, 146*c* for the injectors 100*a*, 100*b*, 100*c*, such that the piston 104 of at least one of the injectors 100*a*, 100*b*, 100*c* is always moving through its displacement stroke to continuously deliver molten metal 134 to the outlet manifold 140 at a substantially constant flow rate and pressure. The pistons 104 of the remaining injectors 100*a*, 100*b*, 100*c* may be in a recovery mode wherein the pistons 104 are moving through their return strokes, or finishing their displacement strokes. Thus, in view of the foregoing, at least one of the injectors 100*a*, 100*b*, 100*c* is always in "operation", providing molten metal 134 to the outlet manifold 140 while the pistons 104 of the remaining injectors 100*a*, 100*b*, 100*c* are recovering and moving through their return strokes (or finishing their displacement strokes).

Figure 5:
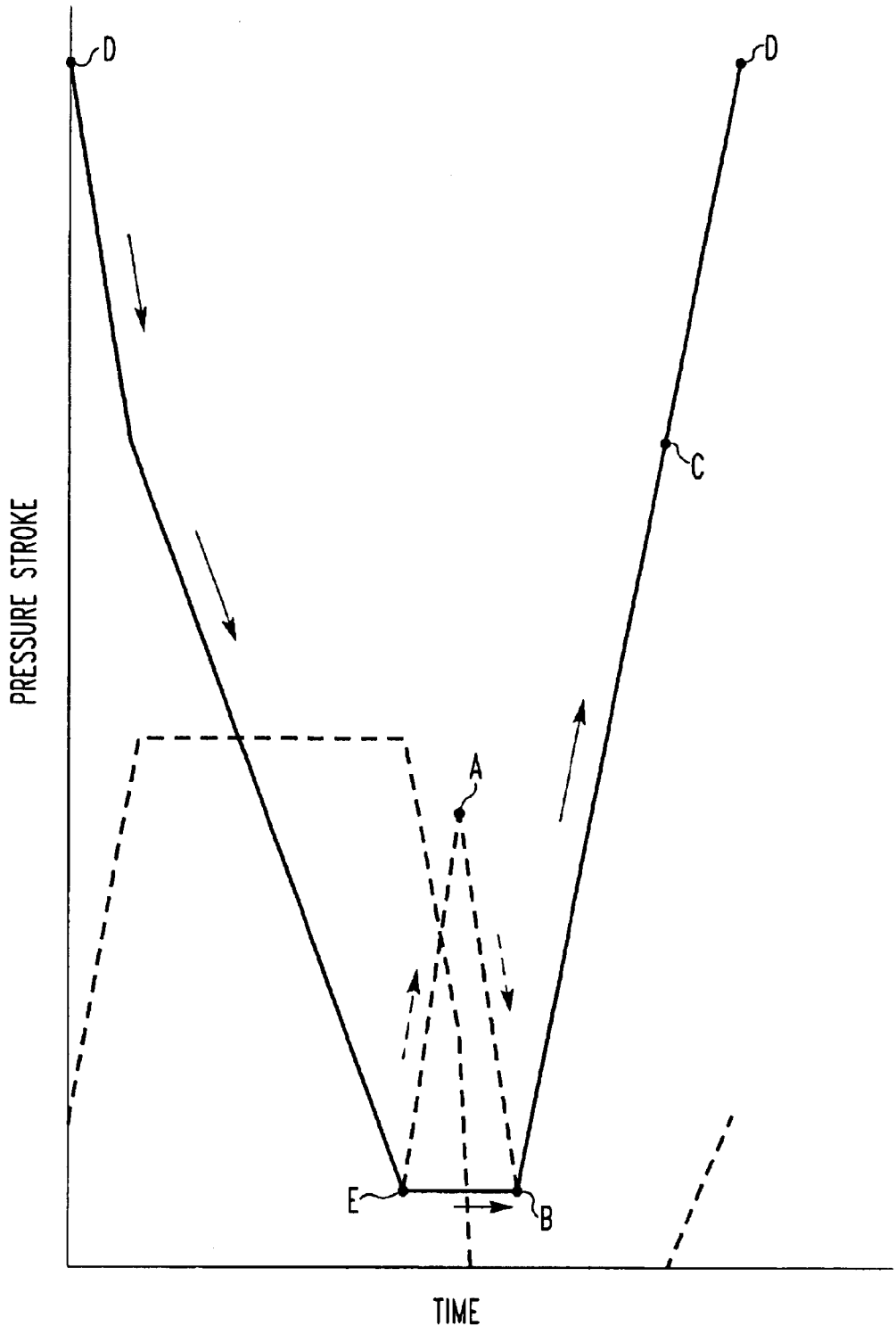
FIG. 5 is a graph of piston position versus time for one injection cycle of the injector of FIGS. 3 and 4.

Referring to FIGS. 3–5, operation of one of the injectors 100*a*, 100*b*, 100*c* incorporated in the molten metal supply system 90 of FIG. 2 will now be discussed. In particular, the operation of one of the injectors 100 through one complete injection cycle (i.e., return stroke and displacement stroke) will now be discussed. FIG. 3 shows the injector 100 at a point just prior to the piston 104 beginning a displacement (i.e., downward) stroke in the housing 102, having just finished its return stroke. The space 148 between the pistonhead 108 and the molten metal 134 is substantially filled with gas from the gas supply source 144, which was supplied through the gas control valve 146. The gas control valve 146 is operable to supply gas from the gas supply source 144 to the space 148 (i.e., pressurize), vent the space 148 to atmospheric pressure, and to close off the gas filled space 148 when necessary during the reciprocal movement of the piston 104 in the housing 102.

As stated hereinabove, in FIG. 3 the piston 104 has completed its return stroke within the housing 102 and is ready to begin a displacement stroke. The gas control valve 146 is in a closed position, which prevents the gas in the gas filled space 148 from discharging to atmospheric pressure. The location of the piston 104 within the housing 102 in FIG. 3 is represented by point D in FIG. 5. The control unit 160 sends a signal to the hydraulic actuator 114 to begin moving the piston 104 downward through its displacement stroke. As the piston 104 moves downward in the housing 102, the gas in the gas filled space 148 is compressed in situ between the pistonhead 108 and the molten metal 134 received in the housing 102, substantially reducing its volume and increasing the pressure in the gas filled space 148. The pressure transducer 149 monitors the pressure in the gas filled space 148 and provides this information as a process value input to the control unit 160.

When the pressure in the gas filled space 148 reaches a "critical" level, the molten metal 134 in the housing 102 begins to flow into the port 138 and out of the housing 102 through the second check valve 142. The critical pressure level will be dependent upon the downstream process to which the molten metal 134 is being delivered through the outlet manifold 140 (shown in FIG. 2). For example, the outlet manifold 140 may be connected to a metal extrusion process or a metal rolling process. These processes will provide different amounts of return or "back pressure" to the injector 100. The injector 100 must overcome this back pressure before the molten metal 134 will begin to flow out of the housing 102. The amount of back pressure experienced at the injector 100 will also vary, for example, from one downstream extrusion process to another. Thus, the critical pressure at which the molten metal 134 will begin to flow from the housing 102 is process dependent and its determination is within the skill of those skilled in the art. The pressure in the gas filled space 148 is continuously monitored by the pressure transducer 149, which is used to identify the critical pressure at which the molten metal 134 begins to flow from the housing 102. The pressure transducer 149 provides this information as an input signal (i.e., process value input) to the control unit 160.

At approximately this point in the displacement movement of the piston 104 (i.e., when the molten metal 134 begins to flow from the housing 102), the control unit 160, based upon the input signal received from the pressure transducer 149, regulates the downward movement of the hydraulic actuator 114, which controls the downward movement (i.e., speed) of the piston 104, and ultimately, the flow rate at which the molten metal 134 is displaced from the housing 102 through the port 138 and to the outlet manifold 140. For example, the control unit 160 may speed up or slow down the downward movement of the hydraulic actuator 114 depending on the molten metal flow rate desired at the outlet manifold 140 and the ultimate downstream process. Thus, the control of the hydraulic actuator 114 provides the ability to control the molten metal flow rate to the outlet manifold 140. The insulation barrier 150 and compressed gas filled space 148 separate the end of the pistonhead 108 from direct contact with the molten metal 134 throughout the displacement stroke of the piston 104. In particular, the molten metal 134 is displaced from the housing 102 in advance of the floating insulation barrier 150, the compressed gas filled space 148, and the pistonhead 108. Eventually, the piston 104 reaches the end of the downstroke or displacement stroke, which is represented by point E in FIG. 5. At the end of the displacement stroke of the piston 104, the gas filled space 148 is tightly compressed and may generate extremely high pressures on the order of greater than 20,000 psi.

After the piston 104 reaches the end of the displacement stroke (point E in FIG. 5), the piston 104 optionally moves upward in the housing 102 through a short "reset" or return stroke. To move the piston 104 through the reset stroke, the control unit 160 actuates the hydraulic actuator 114 to move the piston 104 upward in the housing 102. The piston 104 moves upward a short "reset" distance in the housing 102 to a position represented by point A in FIG. 5. The optional short reset or return stroke of the piston 104 is shown as a broken line in FIG. 5. By moving upward a short reset distance within the housing 102, the volume of the compressed gas filled space 148 increases thereby reducing the gas pressure in the gas filled space 148. As stated previously, the injector 100 is capable of generating high pressures in the gas filled space 148 on the order of greater than 20,000 psi. Accordingly, the short reset stroke of the piston 104 in the housing 102 may be utilized as a safety feature to partially relieve the pressure in the gas filled space 148 prior to venting the gas filled space 148 to atmospheric pressure through the gas control valve 146. This feature protects the housing 102, annular pressure seal 120, and gas control valve 146 from damage when the gas filled space 148 is vented. Additionally, as will be appreciated by those skilled in the art, the volume of gas compressed in the gas filled space 148 is relatively small, so even though relatively high pressures are generated in the gas filled space 148, the amount of stored energy present in the compressed gas filled space 148 is low.

At point A, the gas control valve 146 is operated by the control unit 160 to an open or vent position to allow the gas in the gas filled space 148 to vent to atmospheric pressure, or to a gas recycling system (not shown). As shown in FIG. 5, the piston 104 only retracts a short reset stroke in the housing 102 before the gas control valve 146 is operated to the vent position. Thereafter, the piston 104 is operated (by the control unit 160 through the hydraulic actuator 114) to move downward to again reach the previous displacement stroke position within the housing 102, which is identified by point B in FIG. 5. If the reset stroke is not followed, the gas filled space 148 is vented to atmospheric pressure (or the gas recycling system) at point E and the piston 104 may begin the return stroke within the housing 102, which will also begin at point B in FIG. 5.

At point B, the gas control valve 146 is operated by the control unit 160 from the vent position to a closed position and the piston 104 begins the return or upstroke in the housing 102. The piston 104 is moved through the return stroke by the hydraulic actuator 114, which is signaled by the control unit 160 to begin moving the piston 104 upward in the housing 102. During the return stroke of the piston 104, molten metal 134 from the molten metal supply source 132 flows into the housing 102. In particular, as the piston 104 begins moving through the return stroke, the pistonhead 108 begins to form the space 148, which is now substantially at sub-atmospheric (i.e., vacuum) pressure. This causes molten metal 134 from the molten metal supply source 132 to enter the housing 102 through the first check valve 136. As the piston 104 continues to move upward in the housing 102, the molten metal 134 continues to flow into the housing 102. At a certain point during the return stroke of the piston 104, which is represented by point C in FIG. 5, the housing 102 is preferably completely filled with molten metal 134. Point C may also be a preselected point where a preselected amount of the molten metal 134 is received into the housing. However, it is preferred that point C correspond to the point during the return stroke of the piston 104 that the housing 102 is substantially full of molten metal 134. At point C, the gas control valve 146 is operated by the control unit 160 to a position placing the housing 102 in fluid communication with the gas supply source 144, which pressurizes the "vacuum" space 148 with gas, such as argon or nitrogen, forming a new gas filled space (i.e., a "gas charge") 148. The piston 104 continues to move upward in the housing 102 as the gas filled space 148 is pressurized.

At point D (i.e., the end of the return stroke of the piston 104) during the gas control valve 146 is operated by the control unit 160 to a closed position, which prevents further charging of gas to the gas filled space 148 formed between the pistonhead 108 and molten metal 134, as well as preventing the discharge of gas to atmospheric pressure. The control unit 160 further signals the hydraulic actuator 114 to stop moving the piston 104 upward in the housing 102. As stated, the end of the return stroke of the piston 104 is represented by point D in FIG. 5, and may coincide with the full return stroke position of the piston 104 (i.e., the maximum possible upward movement of the piston 104) within the housing 102, but not necessarily. When the piston 104 reaches the end of the return stroke (i.e., the position of the piston 104 shown in FIG. 3), the piston 104 may be moved downward through another displacement stroke and the injection cycle illustrated in FIG. 5 begins over again.

Figure 6:
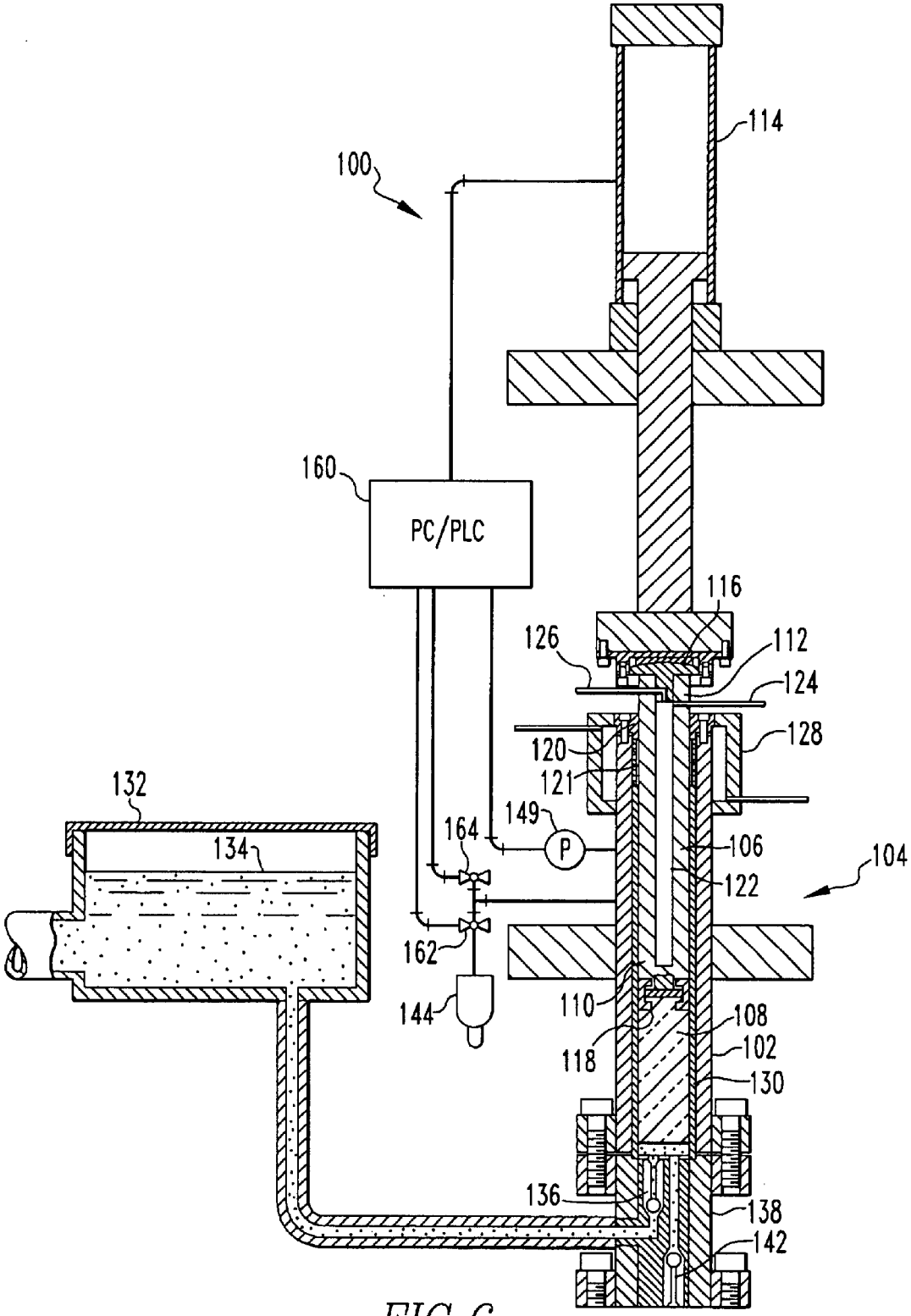
FIG. 6 is an alternative gas supply and venting arrangement for the injector of FIGS. 3 and 4.

As will be appreciated by those skilled in the art, the gas control valve 146 utilized in the injection cycle described hereinabove will require appropriate sequential and separate actuation of the gas supply (i.e., pressurization) and vent functions (i.e., ports) of the control valve 146 of the injector 100. The embodiment of the present invention in which the gas supply (i.e., pressurization) and vent functions are preformed by two individual valves would also require sequential activation of the valves. The embodiment of the molten supply system 90 wherein the gas control valve 146 is replaced by two separate valves in the injector 100 is shown in FIG. 6. In FIG. 6, the gas supply and vent functions are performed by two individual valves 162, 164 that operate, respectively, as gas supply and vent valves.

With the operation of one of the injectors 100*a*, 100*b*, 100*c* through a complete injection cycle now described, operation of the molten metal supply system 90 will now be described with reference to FIGS. 2–5 and 8. The molten metal supply system 90 is generally configured to sequentially or serially operate the injectors 100*a*, 100*b*, 100*c* such that at least one of the injectors 100*a*, 100*b*, 100*c* is operating to supply molten metal 134 to the outlet manifold 140. In particular, the molten metal supply system 90 is configured to operate the injectors 100*a*, 100*b*, 100*c* such that the piston 104 of at least one of the injectors 100*a*, 100*b*, 100*c* is moving through a displacement stroke while the pistons 104 of the remaining injectors 100*a*, 100*b*, 100*c* are recovering and moving through their return strokes or finishing their displacement strokes.

Figure 7:
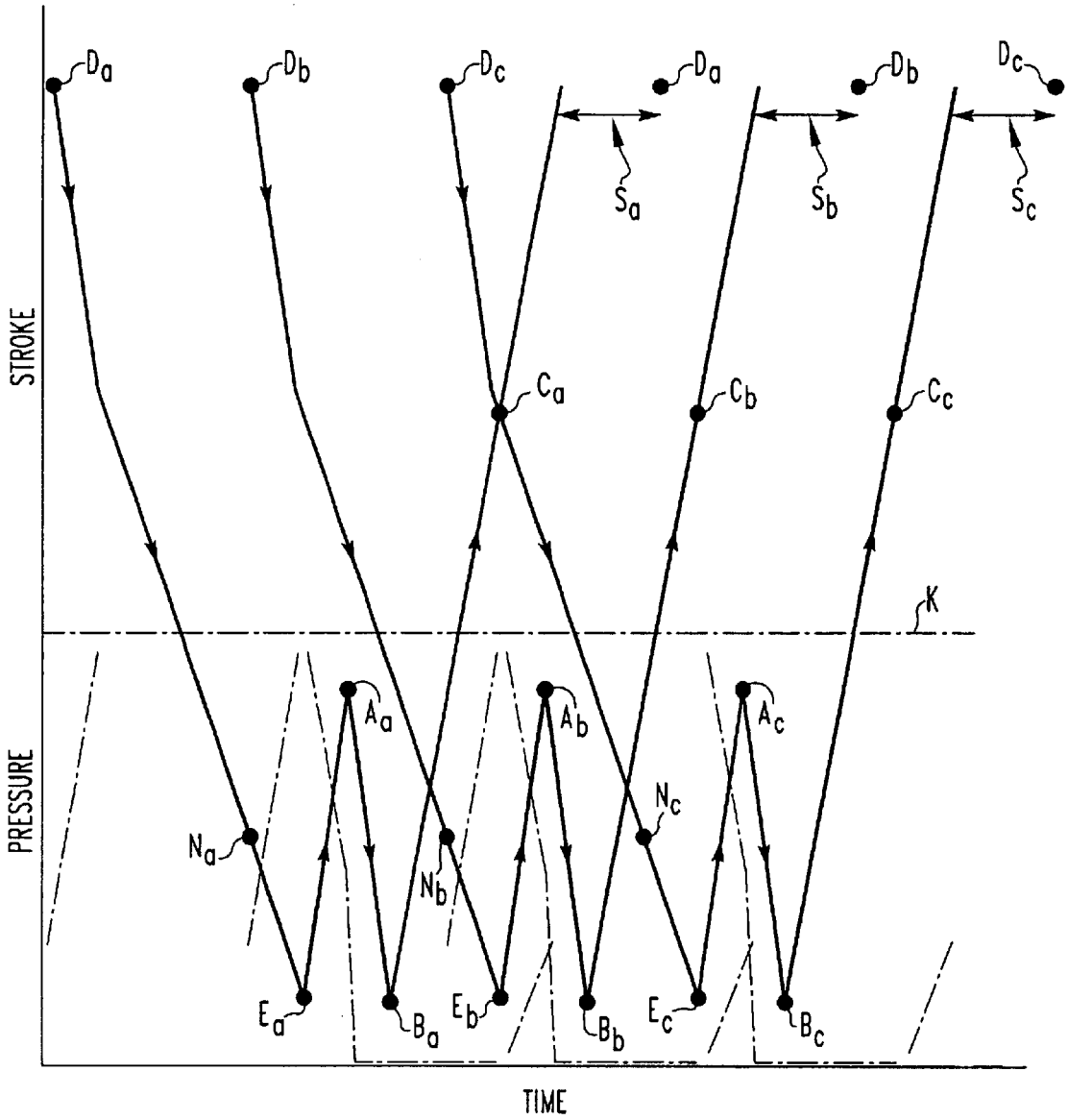
FIG. 7 is a graph of piston position versus time for the multiple injectors of the molten metal supply system of FIG. 2.

As shown in FIG. 7, the injectors 100*a*, 100*b*, 100*c* each sequentially follow the same movement described hereinabove in connection with FIG. 5, but begin their injection cycles at different (i.e., "staggered") times so that the arithmetic average of their delivery strokes results in a constant molten metal flow rate and pressure being provided to the outlet manifold 140 and the ultimate downstream process. The arithmetic average of the injection cycles of the injectors 100*a*, 100*b*, 100*c* is represented by broken line K in FIG. 7. The control unit 160, described previously, is used to sequence the operation of the injectors 100*a*, 100*b*, 100*c* and gas control valves 146*a*, 146, 146*c* to automate the process described hereinafter.

In FIG. 7, the first injector 100*a* begins its downward movement at point $D_a$, which corresponds to time equal to zero (i.e., t=0). The piston 104 of the first injector 100*a*follows its displacement stroke in the manner described in connection with FIG. 5. During the displacement stroke of the piston 104 of the first injector 100*a*, the injector 100*a* supplies molten metal 134 to the outlet manifold 140 through its port 138. As the piston 104 of the first injector 100*a* nears the end of its displacement stroke at point $N_a$, the piston 104 of the second injector 100*b* begins its displacement stroke at point $D_b$. The piston 104 of the second injector 100*b* follows its displacement stroke in the manner described in connection with FIG. 5 and substantially takes over supplying the molten metal 134 to the outlet manifold 140. As may be seen in FIG. 7, the displacement strokes of the pistons 104 of the first and second injectors 100*a*, 100*b* overlap for a short period until the piston 104 of the first injector 100*a*reaches the end of its displacement stroke represented by point $E_a$.

After the piston 104 of the first injector 100*a* reaches point $E_a$ (i.e., the end of the displacement stroke), the first injector 100*a* may sequence through the short reset stroke and venting procedure discussed previously in connection with FIG. 5. The piston 104 then returns to the end of the displacement stroke at point $B_a$ before beginning its return stroke. Alternatively, the first injector 100*a* may be sequenced to vent the gas filled space 148 at point $E_a$, and its piston 104 may begin a return stroke at point $B_a$ in the manner described previously in connection with FIG. 5.

As the piston 104 of the first injector 100*a* moves through its return stroke, the piston 104 of the second injector 100*b* moves near the end of its displacement stroke at point $N_b$. Substantially simultaneously with the second injector 100*b* reaching point $N_b$, the piston 104 of the third injector 100*c* begins to move through its displacement stroke at point $D_c$. The first injector 100*a* simultaneously continues its upward movement and is preferably completely refilled with molten metal 134 at point $C_a$. The piston 104 of the third injector 100*c* follows its displacement stroke in the manner described previously in connection with FIG. 5, and the third injector 100*c* now substantially takes over supplying the molten metal 134 to the outlet manifold 140 from the first and second injectors 100*a*, 100*b*. However, as may be seen from FIG. 7 the displacement strokes of the pistons 104 of the second and third injectors 100*b*, 100*c* now partially overlap for a short period until the piston 104 of the second injector 100*b* reaches the end of its displacement stroke at point $E_b$.

After the piston 104 of the second injector 100*b* reaches point $E_b$ (i.e., the end of the displacement stroke), the second injector 100*b* may sequence through the short reset stroke and venting procedure discussed previously in connection with FIG. 5. The piston 104 then returns to the end of the displacement stroke at point $B_b$ before beginning its return stroke. Alternatively, the second injector 100*b* may be sequenced to vent the gas filled space 148 at point $E_b$, and its piston 104 may begin a return stroke at point $B_b$ in the manner described previously in connection with FIG. 5. At approximately point $A_b$ of the piston 104 of the second injector 100*b*, the first injector 100*a* is substantially fully recovered and ready for another displacement stroke. Thus, the first injector 100*a* is poised to take over supplying the molten metal 134 to the outlet manifold 140 when the third injector 100*c* reaches the end of its displacement stroke.

The first injector 100*a* is held at point $D_a$ for a slack period $S_a$ until the piston 104 of the third injector 100*c* nears the end of its displacement stroke at point $N_c$. The piston 104 of the second injector 100*b* simultaneously moves through its return stroke and the second injector 100*b* recovers. After the slack period $S_a$, the piston 104 of the first injector 100*a* begins another displacement stroke to provide continuous molten metal flow to the outlet manifold 140. Eventually, the piston 104 of the third injector 100*c* reaches the end of its displacement stroke at point $E_c$.

After the piston 104 of the third injector 100*c* reaches point $E_c$ (i.e., the end of the displacement stroke), the third injector 100*c* may sequence through the short reset stroke and venting procedure discussed previously in connection with FIG. 5. The piston 104 then returns to the end of the displacement stroke at point $B_c$ before beginning its return stroke. Alternatively, the third injector 100*c* may be sequenced to vent the gas filled space 148 at point $E_c$, and its piston 104 may begin a return stroke at point $B_c$ in the manner described previously in connection with FIG. 5. At point $A_c$, the second injector 100*b* is substantially fully recovered and is poised to take over supplying the molten metal 134 to the outlet manifold 140. However, the second injector 100*b* is held for a slack period $S_b$ until the piston 104 of the third injector 100*c* begins its return stroke. During the slack period $S_b$, the first injector 100*a* supplies the molten metal 134 to the outlet manifold 140. The third injector 100*c* is held for a similar slack period $S_c$ when the piston 104 of the first injector 100*a* again nears the end of its displacement stroke (point $N_a$).

In summary, the process described hereinabove is continuous and controlled by the control unit 160, as discussed previously. The injectors 100*a*, 100*b*, 100*c* are respectively actuated by the control unit 160 to sequentially or serially move through their injection cycles such that at least one of the injectors 100*a*, 100*b*, 100*c* is supplying molten metal 134 to the outlet manifold 140. Thus, at least one of the pistons 104 of the injectors 100*a*, 100*b*, 100*c* is moving through its displacement stroke, while the remaining pistons 104 of the injectors 100*a*, 100*b*, 100*c* are moving through their return strokes or finishing their displacement strokes.

Figure 8:
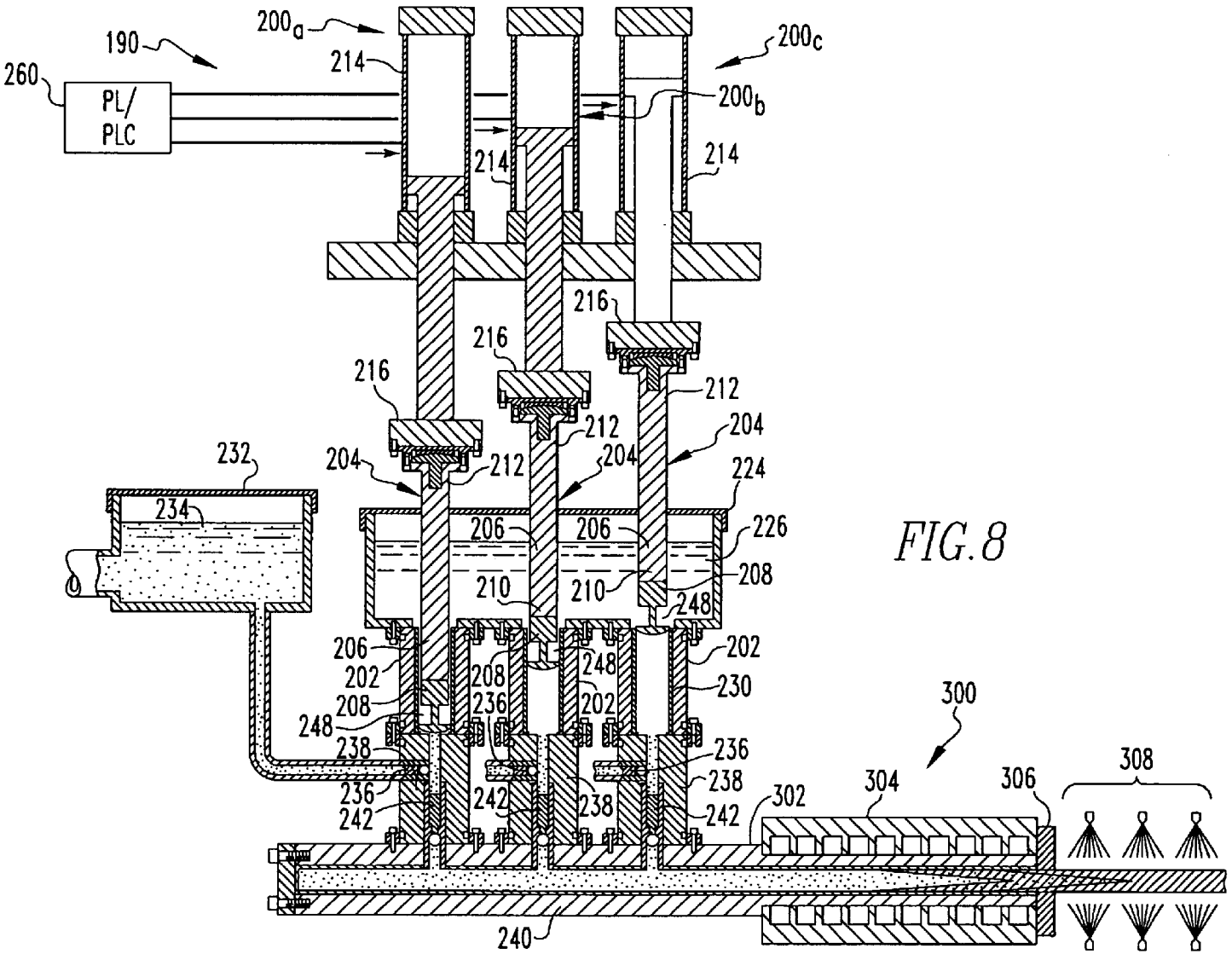
FIG. 8 is a cross-sectional view of the molten metal supply system also including a molten metal supply source, a plurality of molten metal injectors, and an outlet manifold according to a second embodiment of the present invention.

FIG. 8 shows a second embodiment of the molten metal supply system of the present invention and is designated with reference numeral 190. The molten metal supply system 190 shown in FIG. 8 is similar to the molten metal supply system 90 discussed previously, with the molten metal supply system 190 now configured to operate with a liquid medium rather than a gas medium. The molten metal supply system 190 includes a plurality of molten metal injectors 200, which are separately identified with "a", "b", and "c" designations for clarity. The injectors 200*a*, 200*b*, 200*c* are similar to the injectors 100*a*, 100*b*, 100*c* discussed previously, but are now specifically adapted to operate with a viscous liquid source and pressurizing medium. The injectors 200*a*, 200*b*, 200*c* and their component parts are described hereinafter in terms of a single injector "200".

The injector 200 includes an injector housing 202 and a piston 204 positioned to extend downward into the housing 202 and reciprocally operate within the housing 202. The piston 204 includes a piston rod 206 and a pistonhead 208. The pistonhead 208 may be formed separately from and fixed to the piston rod 206 by means customary in the art, or formed integrally with the piston rod 206. The piston rod 206 includes a first end 210 and a second end 212. The pistonhead 208 is connected to the first end 210 of the piston rod 206. The second end 212 of the piston rod 206 is connected to a hydraulic actuator or ram 214 for driving the piston 204 through its reciprocal motion within the housing 202. The piston rod 206 is connected to the hydraulic actuator 214 by a self-aligning coupling 216. The injector 200 is also preferably suitable for use with molten aluminum and aluminum alloys, and the other metals discussed previously in connection with the injector 100. Accordingly, the housing 202, piston rod 206, and pistonhead 208 may be made of any of the materials discussed previously in connection with the housing 102, piston rod 106, and pistonhead 108 of the injector 100. The pistonhead 208 may also be made of refractory material or graphite.

As stated hereinabove, the injector 200 differs from the injector 100 described previously in connection with FIGS. 3–5 in that the injector 200 is specifically adapted to use a liquid medium as a viscous liquid source and pressurizing medium. For this purpose, the molten metal supply system 190 further includes a liquid chamber 224 positioned on top of and in fluid communication with the housing 202 of each of the injectors 200*a*, 200*b*, 200*c*. The liquid chamber 224 is filled with a liquid medium 226. The liquid medium 226 is preferably a highly viscous liquid, such as a molten salt. A suitable viscous liquid for the liquid medium is boron oxide.

As with the injector 100 described previously, the piston 204 of the injector 200 is configured to reciprocally operate within the housing 202 and move through a return stroke in which molten metal is received into the housing 202, and a displacement stroke for displacing the molten metal received into the housing 202 from the housing 202 to a downstream process. However, the piston 204 is further configured to retract upward into the liquid chamber 224. A liner 230 is provided on the inner surface of the housing 202 of the injector 200, and may be made of any of the materials discussed previously in connection with the liner 130.

The molten metal supply system 190 further includes a molten metal supply source 232. The molten metal supply source 232 is provided to maintain a steady supply of molten metal 234 to the housing 202 of each of the injectors 200*a*, 200*b*, 200*c*. The molten metal supply source 232 may contain any of the metals or metal alloys discussed previously in connection with the molten metal supply system 90.

The injector 200 further includes a first valve 236. The injector 200 is in fluid communication with the molten metal supply source 232 through the first valve 236. In particular, the housing 202 of the injector 200 is in fluid communication with the molten metal supply source 232 through the first valve 236, which is preferably a check valve for preventing backflow of molten metal 234 to the molten metal supply source 232 during the displacement stroke of the piston 204. Thus, the first check valve 236 permits inflow of molten metal 234 to the housing 202 during the return stroke of the piston 204.

The injector 200 further includes an intake/injection port 238. The first check valve 236 preferably is located in the intake/injection port 238 (hereinafter "port 238"), which is connected to the lower end of the housing 232. The port 238 may be fixedly connected to the lower end of the housing 202 by means customary in the art, or formed integrally with the housing 202.

The molten metal supply system 190 further includes an outlet manifold 240 for supplying molten metal 234 to a downstream process. The injectors 200*a*, 200*b*, 200*c* are each in fluid communication with the outlet manifold 240. In particular, the port 238 of each of the injectors 200*a*, 200*b*, 200*c* is used as the inlet or intake into each of the injectors 200*a*, 200*b*, 200*c*, and further used to distribute (i.e., inject) the molten metal 234 displaced from the housing 202 of the respective injectors 200*a*, 200*b*, 200*c* to the outlet manifold 240.

The injector 200 further includes a second check valve 242, which is preferably located in the port 238. The second check valve 242 is similar to the first check valve 236, but is now configured to provide an exit conduit for the molten metal 234 received into the housing 202 of the injector 200 to be displaced from the housing 202 and into the outlet manifold 240.

The pistonhead 208 of the injector 200 may be cylindrically shaped and received in a cylindrically shaped housing 202. The pistonhead 208 further defines a circumferentially extending recess 248. The recess 248 is located such that as the piston 204 is retracted upward into the liquid chamber 224 during its return stroke, the liquid medium 226 from the liquid chamber 224 fills the recess 248. The recess 248 remains filled with the liquid medium 226 throughout the return and displacement strokes of the piston 204. However, with each return stroke of the piston 204 upward into the liquid chamber 224, a "fresh" supply of the liquid medium 226 fills the recess 248. In order for liquid medium 226 from the liquid chamber 224 to remain in the recess 248, the pistonhead 208 has a slightly smaller outer diameter than the inner diameter of the housing 202. Accordingly, there is very little to no wear between the pistonhead 208 and housing 202 during operation of the injector 200, and the highly viscous liquid medium 226 prevents the molten metal 234 received into the housing 202 from flowing upward into the liquid chamber 224.

The end portion of the pistonhead 208 defining the recess 248 may be dispensed with entirely, such that during the return and displacement strokes of the piston 204, a layer or column of the liquid medium 226 is present between the pistonhead 208 and the molten metal 234 received into the housing 202 and is used to force the molten metal 234 from the housing 202 ahead of the piston 204 of the injector 200. This is analogous to the "gas filled space" of the injector 100 discussed previously.

Because of the large volume of liquid medium 226 contained in the liquid chamber 224, the injector 200 generally does not require internal cooling as was the case with the injector 100 discussed previously. Additionally, because the injector 200 operates with a liquid medium the gas sealing arrangement (i.e., annular pressure seal 120) found in the injector 100 is not required. Thus, the cooling water jacket 128 discussed previously in connection with the injector 100 is also not required. As stated previously, a suitable liquid for the liquid chamber 224 is a molten salt, such as boron oxide, particularly when the molten metal 234 contained in the molten metal supply source 232 is an aluminum-based alloy. The liquid medium 226 contained in the liquid chamber 224 may be any liquid that is chemically inert or resistive (i.e., substantially non-reactive) to the molten metal 234 contained in the molten metal supply source 232.

The molten metal supply system 190 shown in FIG. 8 operates in an analogous manner to the molten metal supply system 90 discussed previously with minor variations. For example, because the injectors 200*a*, 200*b*, 200*c* operate with a liquid medium rather than a gas medium the gas control valves 146*a*, 146*b*, 146*c* are not required and the injectors 200*a*, 200*b*, 200*c* do not sequence move through the "reset" stroke and venting procedure discussed in connection with FIG. 5. In contrast, the liquid chamber 224 provides a steady supply of liquid medium 224 to the injectors 200*a*, 200*b*, 200*c*, which act to pressurize the injectors 200*a*, 200*b*, 200*c*. The liquid medium 224 may also provide certain cooling benefits to the injectors 200*a*, 200*b*, 200*c*.

Operation of the molten metal supply system 190 will now be discussed with continued reference to FIG. 8. The entire process described hereinafter is controlled by a control unit 260 (PC/PLC), which controls the operation and movement of the hydraulic actuator 214 connected to the piston 204 of each of the injectors 200*a*, 200*b*, 200*c* and thus, the movement of the respective pistons 204. As was the case with the molten metal supply system 90 discussed previously, the control unit 160 sequentially or serially actuates the injectors 200*a*, 200*b*, 200*c* to continuously provide molten metal flow to the outlet manifold 240 at substantially constant operating pressures. Such sequential or serial actuation is accomplished by appropriate control of the hydraulic actuator 214 connected to the piston 204 of each of the injectors 200*a*, 200*b*, 200*c*, as will be appreciated by those skilled in the art.

In FIG. 8, the piston 204 of the first injector 200*a* is shown at the end of its displacement stroke, having just finished injecting molten metal 234 into the outlet manifold 240. The piston 204 of the second injector 200*b* is moving through its displacement stroke and has taken over supplying the molten metal 234 to the outlet manifold 240. The third injector 200*c* has completed its return stroke and is fully "charged" with a new supply of the molten metal 234. The piston 204 of the third injector 200*c* preferably withdraws partially upward into the liquid chamber 224 during its return stroke (as shown in FIG. 8) so that the recess 248 formed in the pistonhead 208 is in substantial fluid communication with the liquid medium 226 in the liquid chamber 224. The liquid medium 226 fills the recess 248 with a "fresh" supply of the liquid medium 226. Alternatively, the piston 204 may be retracted entirely upward into the liquid chamber 224 so that a layer or column of the liquid medium 226 separates the end of the piston 204 from contact with the molten metal 234 received into the housing 202. This situation is analogous to the "gas filled space" of the injectors 100*a*, 100*b*, 100*c*, as stated previously. The pistons 204 of the remaining injectors 200*a*, 200*b* will follow similar movements during their return strokes.

Once the second injector 200*b* finishes its displacement stroke, the control unit 260 actuates the hydraulic actuator 214 attached to the piston 204 of the third injector 200*c* to move the piston 204 through its displacement stroke so that the third injector 200*c* takes over supplying the molten metal 234 to the outlet manifold 240. Thereafter, when the piston of the third injector 200*c* finishes its displacement stroke, the control unit 260 again actuates the hydraulic actuator 214 attached to the piston 204 of the first injector 200*a* to move the piston 204 through it displacement stroke so that the first injector 200*a* takes over supplying the molten metal 234 to the outlet manifold 240. Thus, the control unit 260 sequentially or serially operates the injectors 200*a*, 200*b*, 200*c* to automate the above-described procedure (i.e., staggered injection cycles of the injectors 200*a*, 200*b*, 200*c*), which provides a continuous flow of molten metal 234 to the outlet manifold 240 at a substantially constant pressure.

The injectors 200*a*, 200*b*, 200*c*, each operate in the same manner during their injection cycles (i.e., return and displacement strokes). During the return stroke of the piston 204 of each of the injectors 200*a*, 200*b*, 200*c* subatmospheric (i.e., vacuum) pressure is generated within the housing 202, which causes molten metal 234 from the molten metal supply source 232 to enter the housing 202 through the first check valve 236. As the piston 204 continues to move upward, the molten metal 234 from the molten metal supply source 232 flows in behind the pistonhead 208 to fill the housing 202. However, the highly viscous nature of the liquid medium 226 present in the recess 248 and above in the housing 202 prevents the molten metal 234 from flowing upward into the liquid chamber 224. The liquid medium 226 present in the recess 248 and above in the housing 202 provides a "viscous sealing" effect that prevents the upward flow of the molten metal 234 and further enables the piston 204 to develop high pressures in the housing 202 during the displacement stroke of the piston 204 of each of the injectors 200*a*, 200*b*, 200*c*. The viscous liquid medium 226, as will be appreciated by those skilled in the art, is present about the pistonhead 208 and the piston rod 206, as well as filling the recess 248. Thus, the liquid medium 226 contained within the housing 202 (i.e., about the pistonhead 208 and piston rod 206) separates the molten metal 234 flowing into the housing 202 from the liquid chamber 224, providing a "viscous sealing" effect within the housing 202.

During the displacement stroke of the piston 204 of each of the injectors 200*a*, 200*b*, 200*c*, the first check valve 236 prevents back flow of the molten metal 234 to the molten metal supply source 232 in a similar manner to the first check valve 136 of the injectors 100*a*, 100*b*, 100*c*. The liquid medium 226 present in the recess 248, about the pistonhead 208 and piston rod 206, and further up in the housing 202 the viscous sealing effect between the molten metal 234 being displaced from the housing 202 and the liquid medium 226 present in the liquid chamber 224. In addition, the liquid medium 226 present in the recess 248, about the pistonhead 208 and piston rod 206, and further up in the housing 202 is compressed during the downstroke of the piston 204 generating high pressures within the housing 202 that force the molten metal 234 received into the housing 202 from the housing 202. Because the liquid medium 226 is substantially incompressible, the injector 200 reaches the "critical" pressure discussed previously in connection with the injector 100 very quickly. As the molten metal 234 begins to flow from the housing 202, the hydraulic actuator 214 may be used to control the molten metal flow rate at which the molten metal 234 is delivered to the downstream process for each respective injector 200*a*, 200*b*, 200*c*.

In summary, the control unit 260 sequentially actuates the injectors 200*a*, 200*b*, 200*c* to continuously provide the molten metal 234 to the outlet manifold 240. This is accomplished by staggering the movements of the pistons 204 of the injectors 200*a*, 200*b*, 200*c* so that at least one of the pistons 204 is always moving through a displacement stroke. Accordingly, the molten metal 234 is supplied continuously and at a substantially constant operating or working pressure to the outlet manifold 240.

Figure 9:
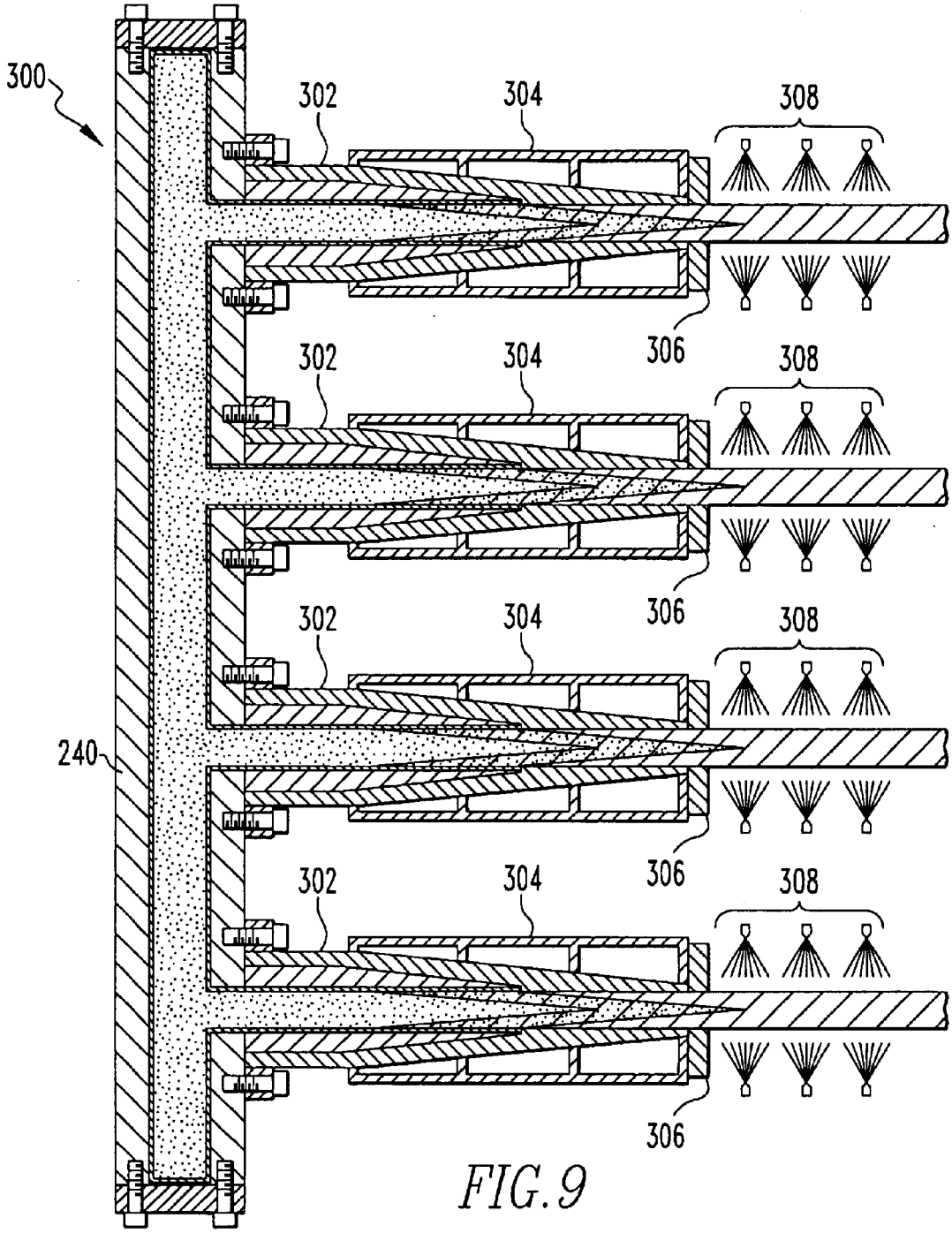
FIG. 9 is a cross-sectional view of the outlet manifold used in the molten metal supply systems of FIGS. 2 and 8 showing the outlet manifold supplying molten metal to an exemplary downstream process.

Finally, referring to FIGS. 8 and 9, the molten metal supply system 200 is shown connected to the outlet manifold 240, as discussed previously. The outlet manifold 240 is further shown supplying molten metal 234 to an exemplary downstream process. The exemplary downstream process is a continuous extrusion apparatus 300. The extrusion apparatus 300 is adapted to form solid circular rods of uniform cross section. The extrusion apparatus 300 includes a plurality of extrusion conduits 302, each of which is adapted to form a single circular rod. The extrusion conduits 302 each include a heat exchanger 304 and an outlet die 306. Each of the heat exchangers 304 is in fluid communication (separately through the respective extrusion conduits 302) with the outlet manifold 240 for receiving molten metal 234 from the outlet manifold 240 under the influence of the molten metal injectors 200*a*, 200*b*, 200*c*. The molten metal injectors 200*a*, 200*b*, 200*c* provide the motive forces necessary to inject the molten metal 234 into the outlet manifold 240 and further deliver the molten metal 234 to the respective extrusion conduits 302 under constant pressure. The heat exchangers 304 are provided to cool and partially solidify the molten metal 234 passing therethrough to the outlet die 306 during operation of the molten metal supply system 190. The outlet die 306 is sized and shaped to form the solid rod of substantially uniform cross section. A plurality of water sprays 308 may be provided downstream of the outlet die 306 for each of the extrusion conduits 302 to fully solidify the formed rods. The extrusion apparatus 300 generally described hereinabove is just one example of the type of downstream apparatus or process with which the molten metal supply systems 90, 190 of the present invention may be utilized. As indicated, the gas operated molten metal supply system 90 may also be in connection with the extrusion apparatus 300.

Referring now to FIGS. 10–25 specific downstream metal forming processes utilizing the molten metal supply systems 90, 190 are shown. The downstream metal forming metal processes are discussed hereinafter with reference to the molten metal supply system 90 of FIG. 2 as the system providing molten metal to the process. However, it will be apparent that the molten metal supply system 190 of FIG. 8 may also be utilized in this role.

Figure 10:
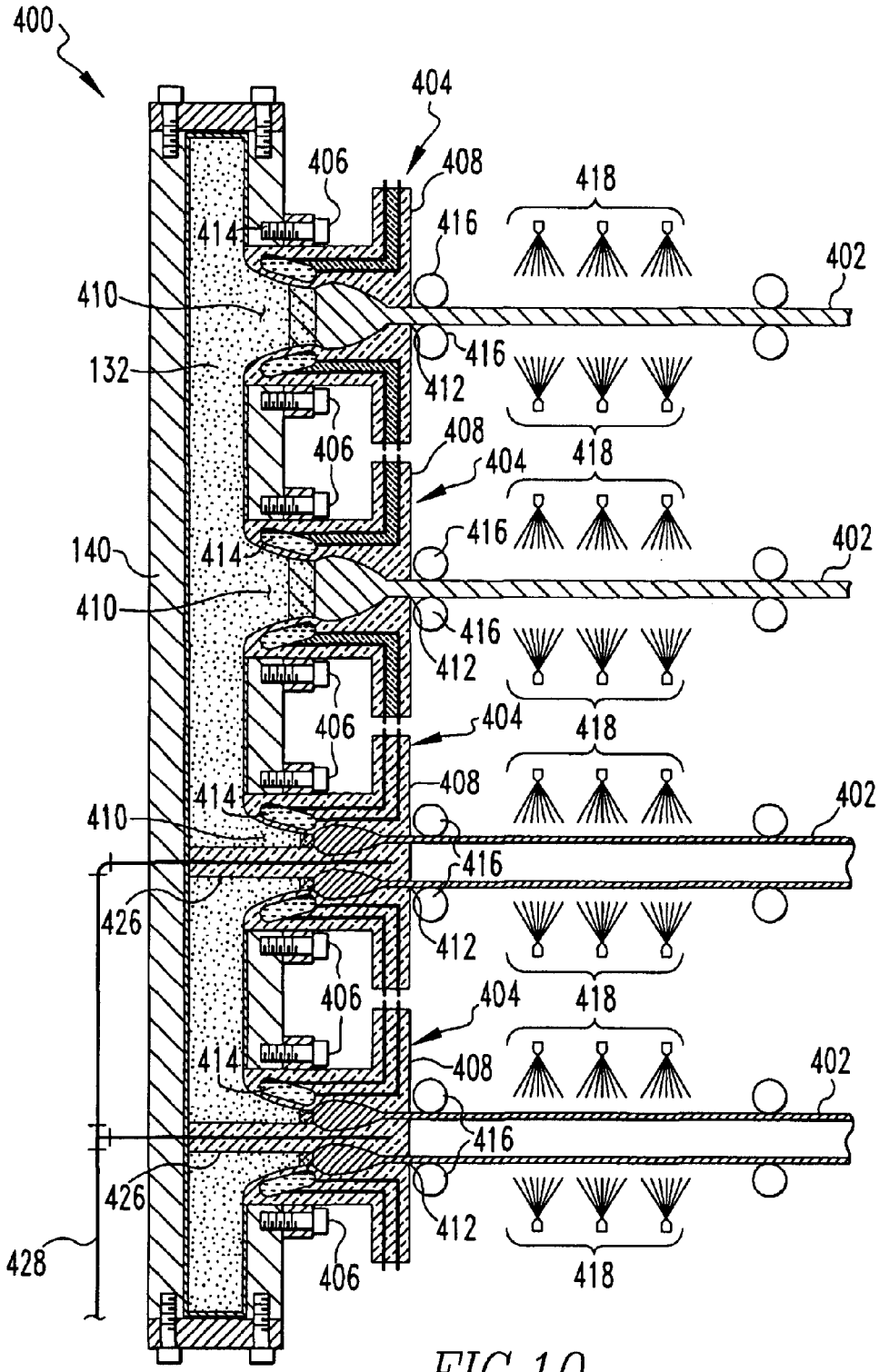
FIG. 10 is plan cross sectional view of an apparatus for forming a plurality of continuous metal articles of indefinite length in accordance with the present invention, which incorporates the manifold of FIGS. 8 and 9.

FIG. 10 generally shows an apparatus 400 for forming a plurality of continuous metal articles 402 of indefinite length. The apparatus includes the manifold 140 discussed previously, which is referred to hereinafter as "outlet manifold 140". The outlet manifold 140 receives molten metal 132 at substantially constant flow rate and pressure from the molten metal supply system 90 in the manner discussed previously. The molten metal 132 is held under pressure in the outlet manifold 140. The apparatus 400 further includes a plurality of outlet dies 404 attached to the outlet manifold 140. The outlet dies 404 may be fixedly attached to the outlet manifold 140 as shown in FIG. 10 or integrally formed with the body of the outlet manifold 140. The outlet dies 404 are shown attached to the outlet manifold 140 with conventional fasteners 406 (i.e., bolts). The outlet dies 404 are further shown in FIG. 10 as being a different material from the outlet manifold 140, but may be made of the same material as the outlet manifold 140 and integrally formed therewith.

Figure 11A:
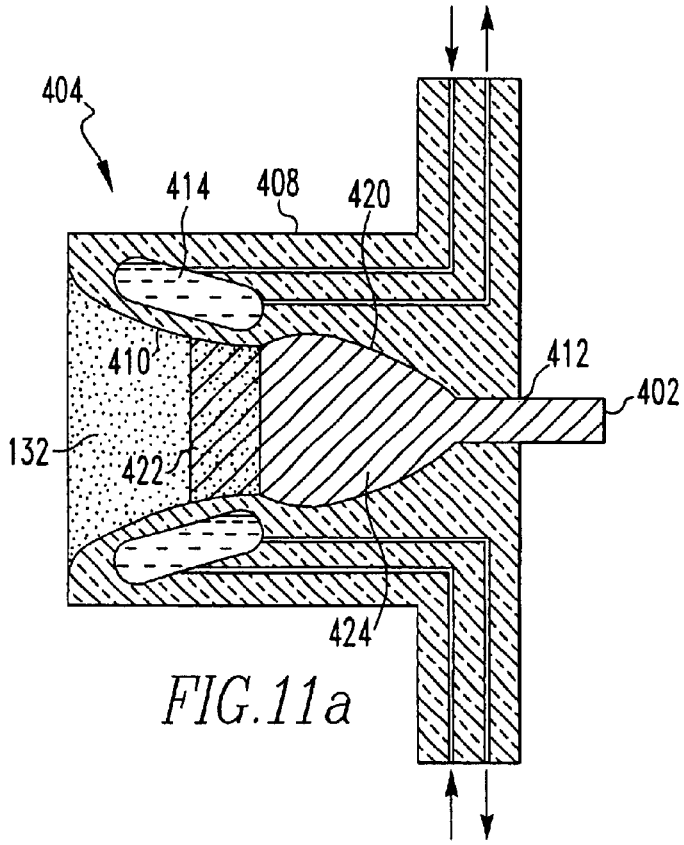
FIG. 11*a* is a cross sectional view of an outlet die configured to form a solid cross section metal article.
Figure 11B:
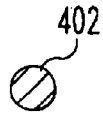
FIG. 11*b* is a cross sectional view of the solid cross section metal article formed by the outlet die of FIG. 11*a;*
Figure 12A:
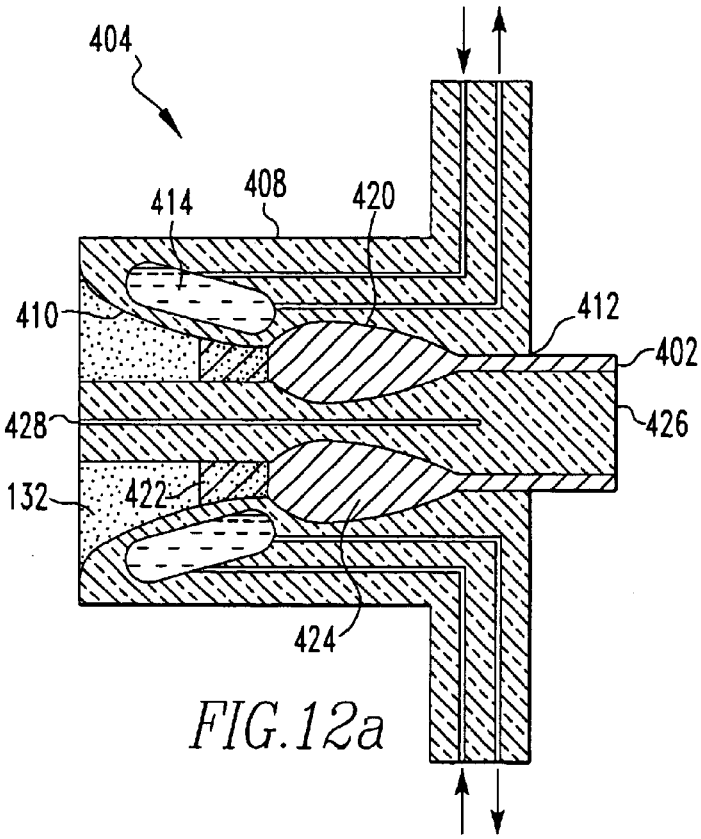
FIG. 12*a* is a cross sectional view of an outlet die configured to form an annular cross section metal article.

Referring to FIGS. 10–12, the outlet dies 404 each include a die housing 408, which is affixed to the outlet manifold 140 in the manner discussed previously. The die housing 408 of each of the outlet dies 404 defines a central die passage 410 in fluid communication with the outlet manifold 140. The die housing 408 defines a die aperture 412 for discharging the respective metal articles 402 from the outlet dies 404. The die passage 410 provides a conduit for molten metal transport from the outlet manifold 140 to the die aperture 412, which is used to shape the metal article 402 into its intended cross sectional form. The outlet dies 404 may be used to produce the same type of continuous metal article 402 or different types of metal articles 402, as discussed further hereinafter. In FIG. 10, two of the outlet dies 404 are configured to form metal articles 402 as circular shaped cross section tubes having an annular or hollow cross section as shown in 12*b*, and two of the outlet dies 404 are configured to form metal articles 402 as solid rods or bars also having a circular shaped cross section as shown in FIG. 11*b*.

Figure 18:
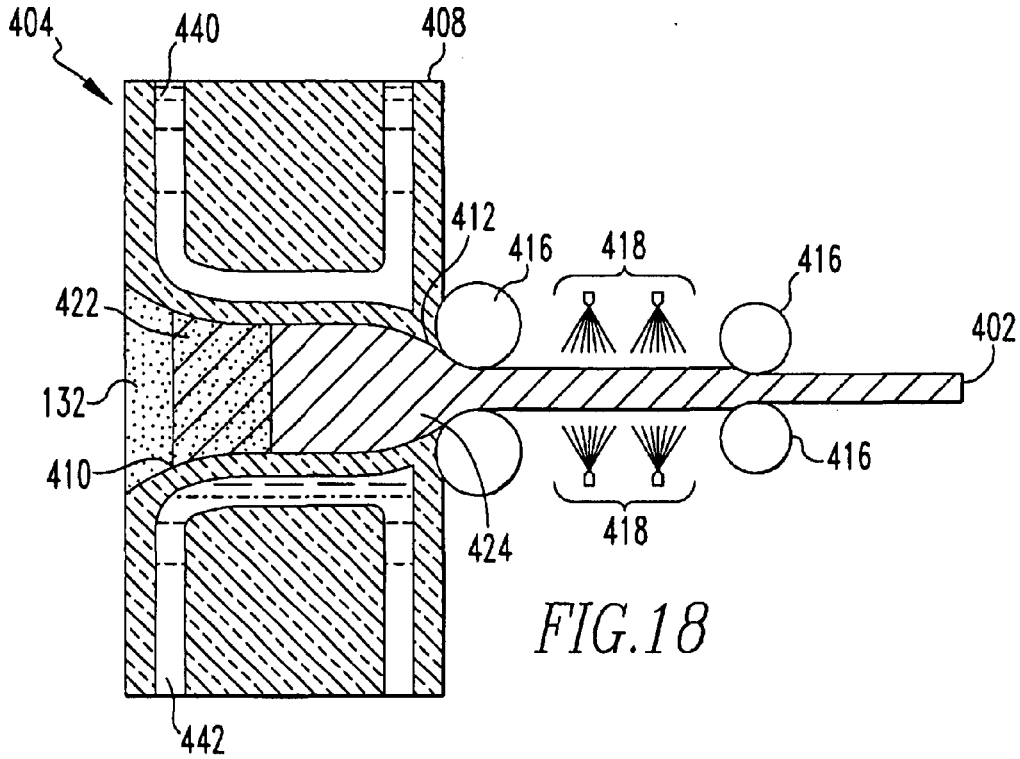
FIG. 18 is a cross sectional view of an outlet die configured to form a continuous metal plate in accordance with the present invention.
Figure 19:
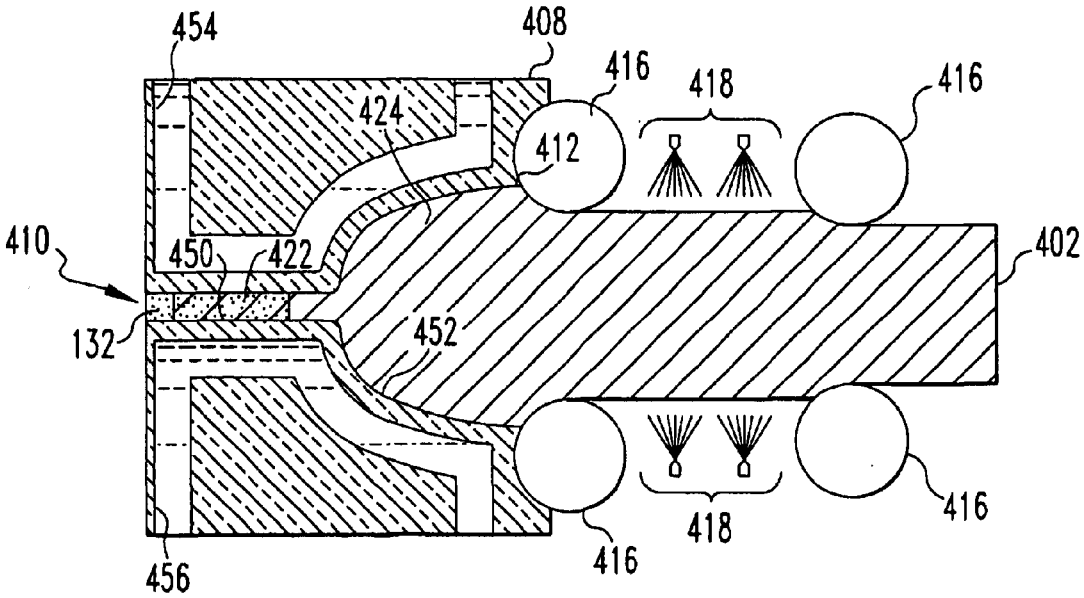
FIG. 19 is a cross sectional view of an outlet die configured to form a continuous metal ingot in accordance with the present invention.

The die housing 408 of each of the outlet dies 404 further defines a cooling cavity or chamber 414 that at least partially surrounds the die passage 410 for cooling the molten metal 132 flowing through the die passage 410 to the die aperture 412. The cooling cavity or chamber 414 may also take the form of cooling conduits as shown in FIGS. 18 and 19 discussed hereinafter. The cooling chamber 414 is provided to cool and solidify the molten metal 132 in the die passage 410 such that the molten metal 132 is fully solidified before it reaches the die aperture 412.

A plurality of rolls 416 is optionally associated with each of the outlet dies 404. The rolls 416 are positioned to contact the formed metal articles 402 downstream of the respective die apertures 412 and, more particularly, frictionally engage the metal articles 402 to provide backpressure to the molten metal 132 in the outlet manifold 140. The rolls 416 also serve as braking mechanisms used to slow the discharge of the metal articles 402 from the outlet dies 404. Due to the high pressures generated by the molten metal supply system 90 and present in the outlet manifold 140, a braking system is beneficial for slowing the discharge of the metal articles 402 from the outlet dies 404. This ensures that the metal articles 402 are fully solidified and cooled prior to exiting the outlet dies 404. A plurality of cooling sprays 418 may be located downstream from the outlet dies 404 to further cool the metal articles 402 discharging from the outlet dies 404.

As discussed previously, FIG. 10 shows the apparatus 400 with two outlet dies 404 configured to form annular cross section metal articles 402 having a circular shape (i.e., tubes), and with two of the outlet dies 404 configured to form solid cross section metal articles 402 having a circular shape (i.e., rods). Thus, the apparatus 400 is capable of simultaneously forming different types of metal articles 402. The particular configuration in FIG. 10 wherein the apparatus 400 includes four outlet dies 404, two for producing annular cross section metal articles 402 and two for producing solid cross section metal articles 402, is merely exemplary for explaining the apparatus 400 and the present invention is not limited to this particular arrangement. The four outlet dies 404 in FIG. 10 may used to produce four different types of metal articles 402. Additionally, the use of four outlet dies 404 is merely exemplary and the apparatus 400 may have any number of outlet dies 400 in accordance with the present invention. Only one outlet die 404 is necessary in the apparatus 400.

The outlet die 404 used to form solid cross section metal rods will now be discussed with reference to FIGS. 10 and 11. The outlet die 404 of FIGS. 10 and 11 further includes a tear-drop shaped chamber 420 upstream of the die aperture 412. The chamber 412 defines a divergent-convergent shape and will be referred to hereinafter as a divergent-convergent chamber 420. The divergent-convergent chamber 420 is positioned just forward of the annular cooling chamber 414. The divergent-convergent chamber 420 is used to cold work solidified metal in the die passage 410, which is solidified as the molten metal 132 passes through the area of the die passage 410 bounded by the cooling chamber 414, prior to discharging the solidified metal through the die aperture 412. In particular, the molten metal 132 flows from the outlet manifold 140 and into the outlet die 404 through the die passage 410. The pressure provided by the molten metal supply system 90 causes the molten metal 132 to flow into the outlet die 404. The molten metal 132 remains in this molten state until the molten metal 132 passes through the area of the die passage 410 generally bounded by the cooling chamber 414. The molten metal 132 becomes semi-solidified in this area, and is preferably fully solidified before reaching the divergent-convergent chamber 420. The semi-solidified metal and fully solidified metal are separately designated with reference numerals 422 and 424 hereinafter.

The solidified metal 424 in the divergent-convergent chamber 420 exhibits an as-cast structure, which is not advantageous. The divergent-convergent shape of the divergent-convergent chamber 420 works the solidified metal 424, which forms a wrought or worked microstructure. The worked microstructure improves the strength of the formed metal article 402, in this case a solid cross section rod having a circular shape. This process is generally akin to cold working metal to improve its strength and other properties, as is known in the art. The worked, solidified metal 424 is discharged under pressure through the die aperture 412 to form the continuous metal article 402. In this case, as stated, the metal article 402 is a solid cross section metal rod 402.

As will be appreciated by those skilled in the art, the process for forming the metal article 402 (i.e., solid circular rod) described hereinabove has numerous mechanical benefits. The molten metal supply system 90 delivers molten metal 132 to the apparatus 400 at constant pressure and flow rate and is thus a "steady state" system. Accordingly, there is theoretically no limit to the length of the formed metal article 402. There is better dimensional control of the cross section of the metal article 402 because there is no "die pressure" and "die temperature" transients. There is also better dimensional control through the length of the metal article 402 (i.e., no transients). Additionally, the extrusion ratio may be based on product performance and not on process requirements. The extrusion ratio may be reduced, which results in extended die life for the die aperture 412. Further, there is less die distortion due to low die pressure (i.e., high temperature, low speed).

As will be further appreciated by those skilled in the art, the process for forming the metal article 402 (i.e., solid circular rod) described hereinabove has numerous metallurgical benefits for the resulting metal article 402. These benefits generally include: (a) elimination of surface liquation and shrinkage porosity; (b) reduction of macrosegregation; (c) elimination of the need for homogenization and reheat treatment steps required in the prior art; (d) increased potential of obtaining unrecrystallized structures (i.e., low Z deformation); (e) better seam weld in tubular structures (as discussed hereinafter); and (f) the elimination of structure variations through the length of the metal article 402 because of the steady state nature of the forming process.

Figure 1:
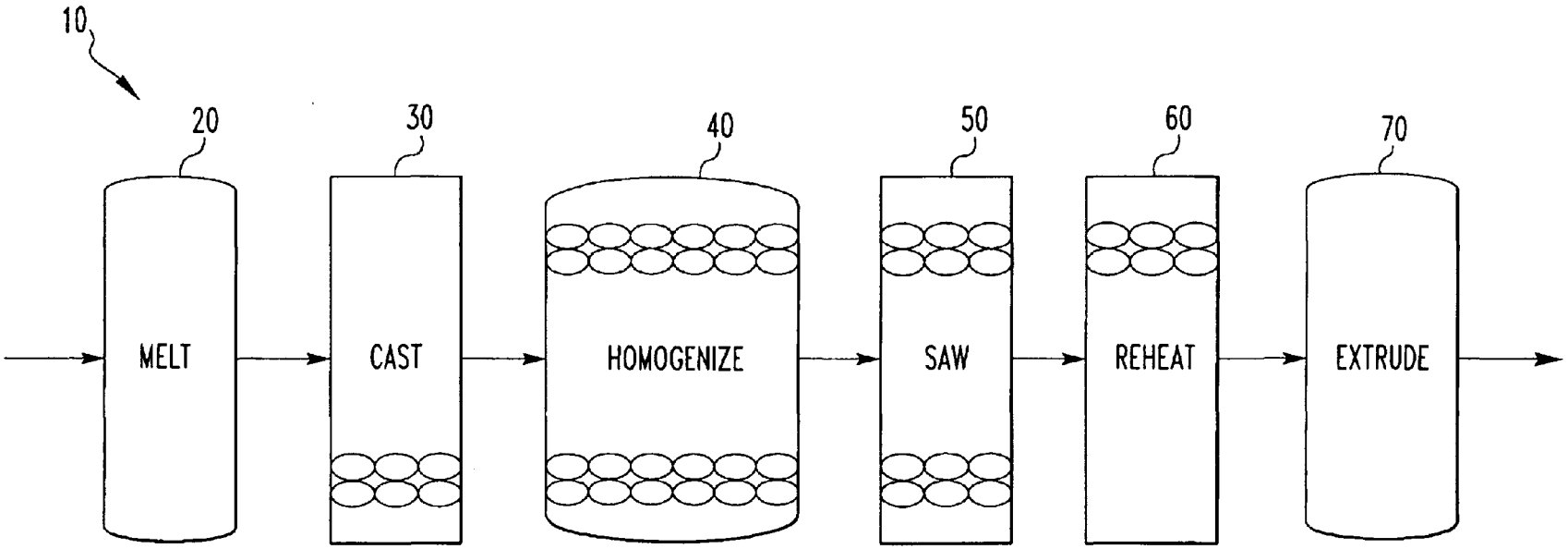
FIG. 1 PRIOR ART
FIG. 1 is a schematic view of a prior art extrusion process.

From an economic standpoint, the foregoing process eliminates in-process inventory and integrates the casting, preheating, reheating, and extrusion steps, which are present in the prior art process discussed previously in connection with FIG. 1, into one step. Additionally, there is no wasted metal in the described process such as that generated in the previously discussed prior art process. Often, in the prior art extrusion process the extruded product must be trimmed and/or scalped, which is not required in the instant process. All of the foregoing benefits apply to each of the different metal articles 402 formed in the apparatus 400 that are discussed hereinafter.

Figure 12B:
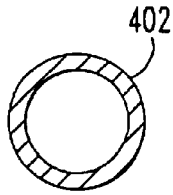
FIG. 12*b* is a cross sectional view of the annular cross section metal article formed by the outlet die of FIG. 12*a;*

Referring now to FIGS. 10 and 12, the apparatus 400 may be used to form metal articles 402 having an annular or hollow cross section, such as the hollow tube shown in FIG. 12*b*. The apparatus 400 for this application further includes a mandrel 426 positioned in the die passage 410. The mandrel 426 preferably extends into the outlet manifold 140, as shown in FIG. 10. The mandrel 426 is preferably internally cooled by circulating a coolant into the interior of the mandrel 426. The coolant may be supplied to the mandrel 426 via a conduit 428 extending into the center of the mandrel 426. The divergent-convergent chamber 420 is again used to work the solidified metal 424 to form a wrought structure in the solidified metal 424 prior to forcing or discharging the solidified metal 424 through the die aperture 412, which forms the annular cross section metal article 402 (i.e., circular shaped tube). The resulting annular cross section metal article 402 is "seamless" meaning that a weld is not required to form the circular structure, as is common practice in the manufacture of pipes and tubes. Additionally, because the molten metal 132 is solidified as an annular structure, the wall of the resulting hollow tube may be made thin during the solidification process without further processing, which could weaken the properties of the metal.

As used in this disclosure, the term "circular" is intended to define not only true circles but also other "rounded" shapes such as ovals (i.e., shapes that are not perfect circles). The outlet dies 404 discussed hereinabove in connection with FIGS. 11 and 12 are generally configured to form metal articles 402 generally having symmetrical circular cross sections. The term "symmetrical cross section" as used in this disclosure is intended to mean that a vertical cross section through the metal article 402 is symmetrical with respect to at least one axis passing through the cross section. For example, the circular cross section of FIG. 11*b* is symmetrical with respect to the diameter of the circle.

Figure 13:
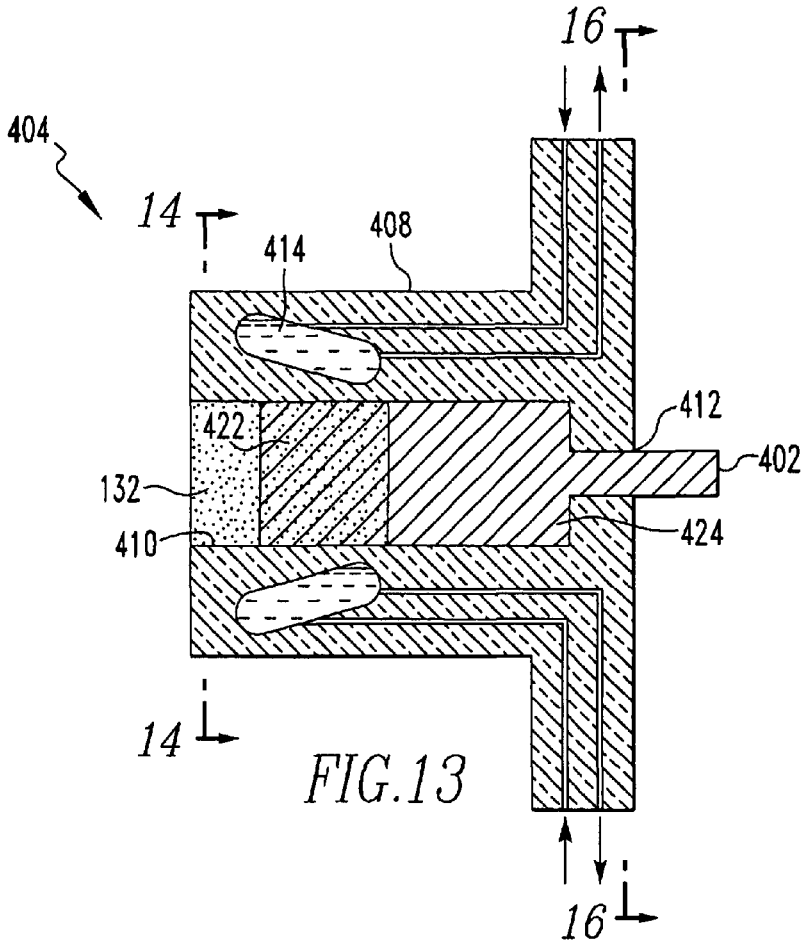
FIG. 13 is a cross sectional view of a third embodiment of the outlet dies shown in FIG. 10.
Figure 14:
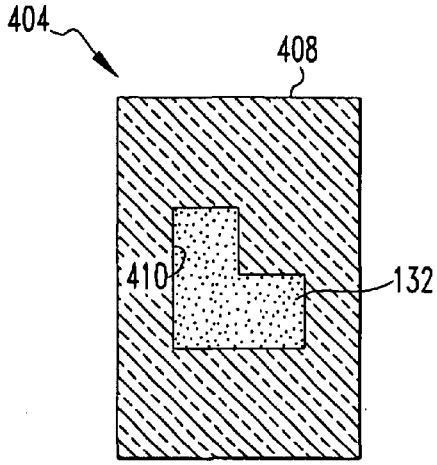
FIG. 14 is a cross sectional view taken along lines 14—14 in FIG. 13.
Figure 16:
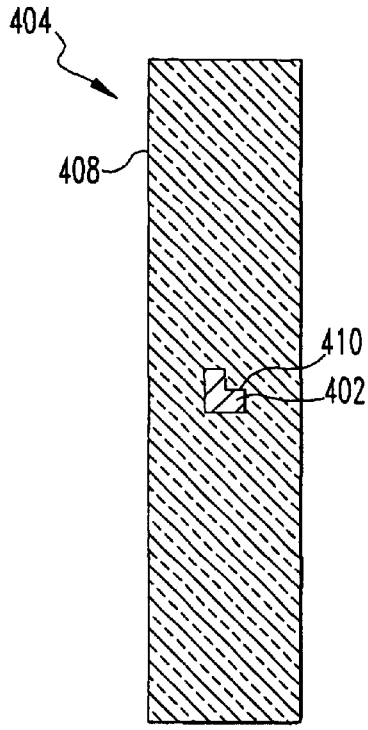
FIG. 16 is a front end view of the outlet die of FIG. 13.
Figure 15:
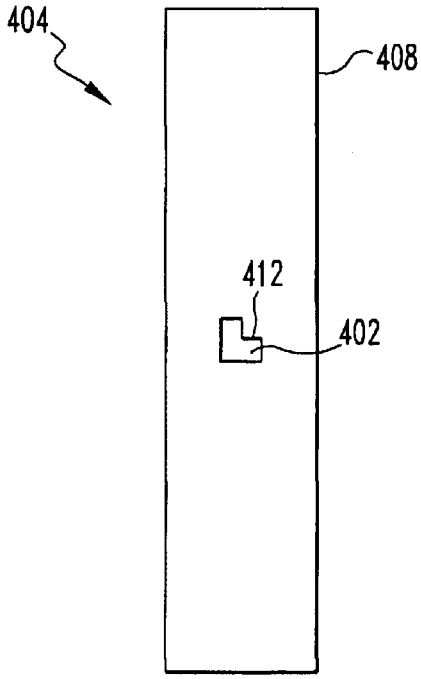
FIG. 15 is a cross sectional view taken along lines 15—15 in FIG. 13.

FIGS. 13–16 shows an embodiment of the outlet die 404 used to form a polygonal shaped metal article 402. As shown in FIGS. 14–16, the formed metal article 402 will have an L-shaped cross section. In particular, it will be obvious from FIGS. 14–16 that the L-shaped (i.e., polygonal shaped cross section) is not symmetrical with respect to any axis passing therethrough. Hence, the apparatus 400 of the present invention may be used to form asymmetrical shaped metal articles 402, such as the L-shaped bar formed by the outlet die 404 of FIGS. 13–16.

The outlet die 404 of FIGS. 13–16 is substantially similar to the outlet dies 404 discussed previously, but does not include a divergent-convergent chamber 420. Alternatively, the die passage 410 has a constant cross section that has the shape of the intended metal article 402, as the cross sectional view of FIG. 14 illustrates. The molten metal 132 passes through the die passage 410 in the manner discussed previously, and is solidified in the area bounded by the cooling chamber 414. The desired wrought structure for the solidified metal 424 is formed by working the solidified metal 424 at the die aperture 412. In particular, as the solidified metal 424 is forced from the larger cross sectional area defined by the die passage 410 into the smaller cross sectional area defined by the die aperture 412, the solidified metal 424 is worked to form the desired wrought structure. The die passage 410 is not limited to having generally the same cross sectional shape as the formed metal article 402. The die passage 410 may have a circular shape, such as that that could potentially be used for the die passage 410 of the outlet dies 404 of FIGS. 11 and 12. The die passage 410 for the outlet die of FIGS. 13–16 may further include the divergent-convergent chamber 420. FIG. 13 illustrates that the desired wrought structure for the solidified metal 424 may be achieved by forcing the solidified metal 424 through a die aperture 412 of reduced cross sectional area with respect to the cross sectional area defined by the upstream die passage 410. The die passage 410 may have the same general shape of the die aperture 412, but the present invention is not limited to this configuration.

Figure 22:
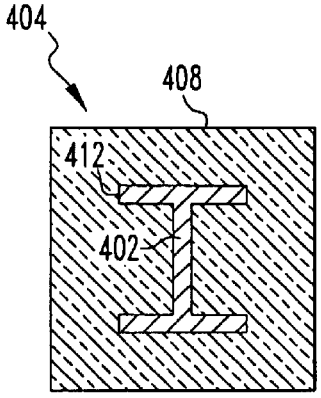
FIG. 22 is a schematic cross sectional view of an outlet die aperture configured to form a continuous metal I-beam of indefinite length.
Figure 23:
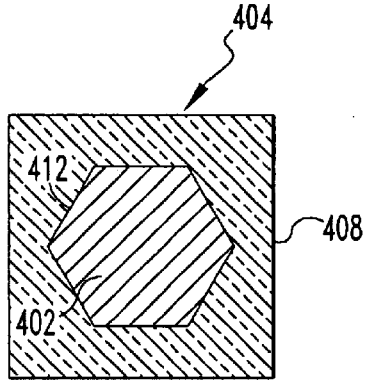
FIG. 23 is a schematic cross sectional view of an outlet die aperture configured to form a continuous profiled rod of indefinite length.
Figure 24:
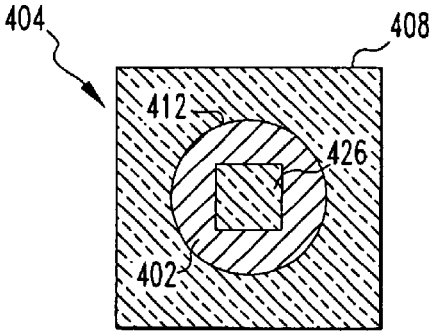
FIG. 24 is a schematic cross sectional view of an outlet die aperture configured to form a continuous circular shaped metal article defining a square shaped central opening.
Figure 25:
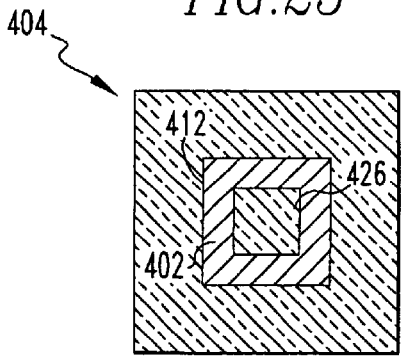
FIG. 25 is a schematic cross sectional view of an outlet die aperture configured to form a square shaped metal article defining a square shaped central opening.

Referring briefly to FIGS. 22–25, other cross sectional shapes are possible for the continuous metal articles 402 formed by the apparatus 400 of the present invention. FIGS. 22 and 23 show symmetrical, polygonal shaped cross section metal articles 402 that may be made in accordance with the present invention. FIG. 22 shows a polygonal shaped I-beam made by an outlet die 404 having an I-shaped die aperture 412. FIG. 23 shows a solid, polygonal shaped rod made by an outlet die 404 having a hexagonal shaped die aperture 412. The hexagonal cross section metal rod 402 formed by the outlet die 404 of FIG. 23 may be referred to as a profiled rod. FIG. 24 illustrates an annular metal article 402 in which the opening in the metal article 402 has a different shape than the overall shape of the metal article 402. In FIG. 24, the opening or annulus in the metal article 402 is square shaped while the overall shape of the metal article 402 is circular. This may be achieved by using a square shaped mandrel 426 in the outlet die 404 of FIG. 12. Further, FIG. 25 illustrates an annular cross section metal article 402 having an overall polygonal shape (i.e., square shape). The die aperture 412 in the outlet die 404 of FIG. 25 is square shaped and a square shaped mandrel 426 is used to form the square shaped opening or annulus in the metal article 402. The metal article 402 of FIG. 25 may be referred to as a profiled tube.

Figure 17:
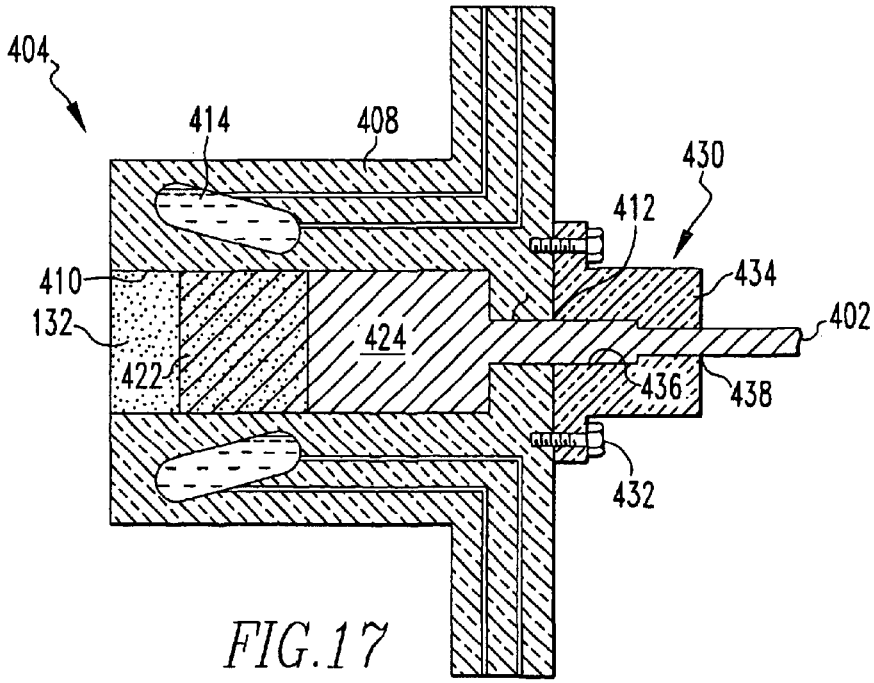
FIG. 17 is a cross sectional view of an outlet die for use with the apparatus of FIG. 10 having a second outlet die attached thereto for further reducing the cross sectional area of the metal article.

Referring to FIG. 17, the present invention envisions that additional or secondary outlet dies may be used to further reduce the cross sectional area of the metal articles 402 and further work the solidified metal 424 forming the metal articles 402 to further improve the desired wrought structure. FIG. 17 shows a second or downstream outlet die 430 attached to the first or upstream outlet die 404. The second outlet die 430 may be attached to the outlet die 404 with mechanical fasteners (i.e., bolts) 432 as shown, or may be formed integrally with the outlet die 404. The embodiment of the outlet die 404 shown in FIG. 17 has a similar configuration to the outlet die 404 of FIG. 13, but may also have the configuration of the outlet die 404 of FIG. 11 (i.e., have a divergent-convergent chamber 420 etc.). The second outlet die 430 includes a housing 434 defining a die passage 436 and a die aperture 438 in a similar manner to the outlet dies 404 discussed previously. The second die passage 436 defines a smaller cross sectional area than the die aperture 412 of the upstream outlet die 404. The second die aperture 438 defines a reduced cross sectional area with respect to the second die passage 436. Additional cold working is carried out as the solidified metal 424 is forced through the second die aperture 438 from the second die passage 436, further improving the wrought structure of the solidified metal 424 forming the metal article 402 and increasing the strength of the metal article 402. The second outlet die 430 may be located immediately adjacent to the upstream outlet die 404, as illustrated, or further downstream from the outlet die 404. The second outlet die 430 also provides an additional cooling area for the solidified metal 424 to cool prior to exiting the apparatus 400, which improves the properties of the solidified metal 424 forming the metal article 402.

Figure 20:
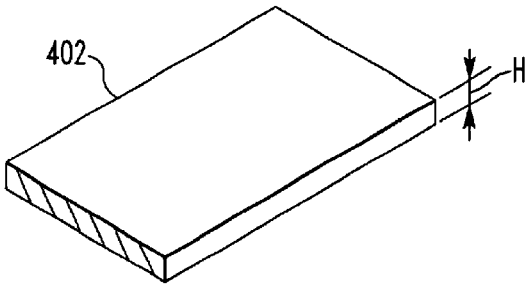
FIG. 20 is perspective view of the metal plate formed by the outlet die of FIG. 18.

Referring to FIGS. 18 and 20, the apparatus 400 may be adapted to form continuous metal plate as the metal article 402. The outlet die 404 of FIG. 18 has a die passage 410 that generally tapers toward the die aperture 412. The die aperture 412 is generally shaped to form the rectangular cross section of the continuous plate article 402 shown in FIG. 20. The cooling chamber 420 is replaced with a pair of cooling conduits 440, 442, which generally bound the length of the die passage 410, as illustrated in FIG. 18. The molten metal 132 is cooled in the die passage 410 to form the semi-solid state metal 422 and finally solidified metal 424 in the die passage 410. The solidified metal 424 is initially worked to form the desired wrought structure by forcing the solidified metal 424 through the smaller cross sectional area defined by the die aperture 412. Additionally, the rolls 416 immediately adjacent the die aperture 412 are used to further reduce the height H of the continuous plate 402, which further works the continuous plate 402 and generates the wrought structure. The continuous plate 402 may have any length because the molten metal 132 is provided to the apparatus 400 in steady state manner. Thus, the apparatus 400 of the present invention is capable of providing rolled sheet metal in addition the rods and bars discussed previously. Additional conventional rolling operations may be carried out downstream of the rolls 416.

Figure 21A:
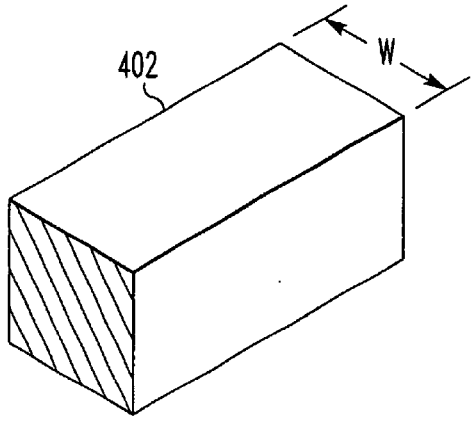
FIG. 21*a* is a perspective view of the metal ingot formed by the outlet die of FIG. 19 and having a polygonal shaped cross section.
Figure 21B:
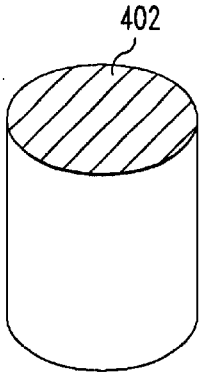
FIG. 21*b* is a perspective view of the metal ingot formed by the outlet die of FIG. 19 and having a circular shaped cross section.

Referring to FIGS. 19 and 21, the apparatus 400 maybe adapted to form a continuous metal ingot as the metal article 402. The outlet die 404 of FIG. 19 has a die passage 410 that is generally divided into two portions. A first portion 450 of the die passage 410 has a generally constant cross section. A second portion 452 of the die passage 410 generally diverges to form the die aperture 412. The die aperture 412 is generally shaped to form the cross sectional shape of the ingot 402 shown in FIG. 21. The cross sectional shape maybe polygonal as shown in FIG. 21*a* or circular as shown in FIG. 21*b*. The cooling chamber 420 is replaced by a pair of cooling conduits 454, 456, which generally bound the length of the first portion 450 of the die passage 410, as illustrated in FIG. 19. The molten metal 132 is cooled in the die passage 410 to form the semi-solid state metal 422 and finally solidified metal 424 in the first portion 450 of the die passage 410. The semi-solid metal 422 is preferably fully cooled forming the solidified metal 424 as the solidified metal 424 reaches the second, larger cross sectional second portion 452 of the die passage 410. The solidified metal 424 is initially worked to form the desired wrought structure as the solidified metal 424 diverges outward from the smaller cross sectional area defined by the first portion 450 of the die passage 410 into the larger cross sectional area defined by the second portion 452 of the die passage 410. Additionally, the rolls 416 immediately adjacent the die aperture 412 are used to further reduce the width W of the continuous ingot 402, which further works the continuous ingot 402 and generates the desired wrought structure. The continuous ingot 402 may have any length because the molten metal 132 is provided to the apparatus 400 in a steady state manner. Thus, the apparatus 400 of the present invention is capable of providing ingots of any desired length in addition to the continuous plate, rods, and bars discussed previously.

The continuous process described hereinabove may be used to form continuous metal articles of virtually any length and any cross sectional shape. The discussion hereinabove detailed the formation of continuous metal rods, bars, ingots, and plate. The process described hereinabove may be used to form both solid and annular cross sectional shapes. Such annular shapes form truly seamless conduits, such as hollow tubes or pipes. The process described hereinabove is also capable of forming metal articles having both symmetrical and asymmetrical cross sections. In summary, the continuous metal forming process described hereinabove is capable of (but not limited to): (a) providing high volume, low extrusion ratio stock shapes; (b) providing premium, thin wall, seamless metal articles such as hollow tubes and pipes; (c) providing asymmetrical cross section metal articles; and (d) providing non-heat treatable, distortion free, F temper metal articles that require no quenching or aging and have no quenching distortion and very low residual stress.

Figure 26:
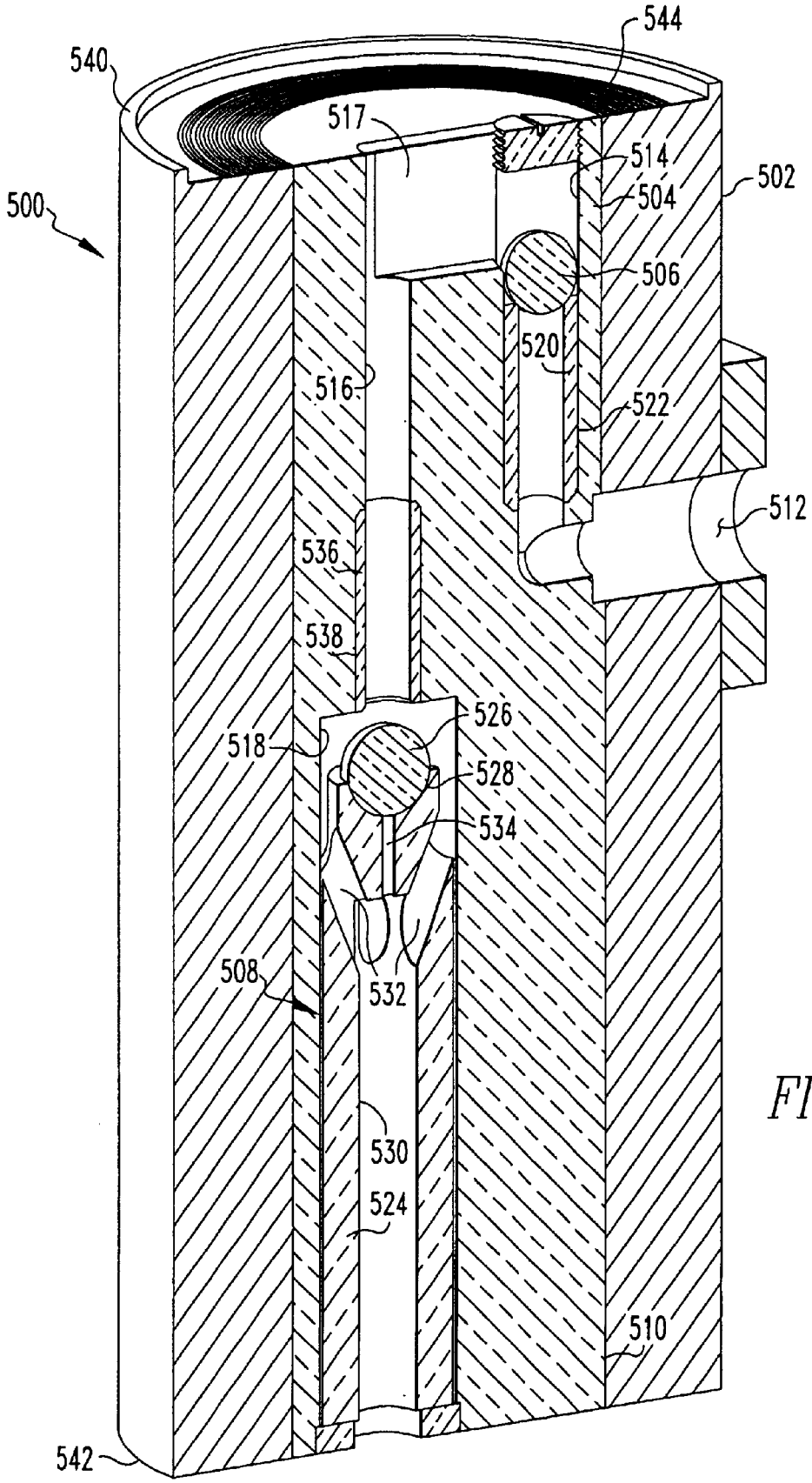
FIG. 26 is a perspective cross sectional view of a dual action valve in accordance with the present invention and provided in the molten metal supply system of FIG. 2.

Referring to FIG. 26, the intake/injection port 138 (shown, for example, in FIG. 2) is preferably provided as a dual action valve 500 in accordance with the present invention. The dual action valve 500 incorporates the first and second valves 136, 142, discussed previously, into a single unit that forms the intake/injection port 138 for each of the injectors 100. Generally, the dual action valve 500 is comprised of a housing 502, a valve body 504 disposed within the housing 502, an inlet float member 506 and an outlet float assembly 508. The housing 502 is annular shaped and defines a central passage 510 extending therethrough. The housing 502 is shown in FIG. 26 as being circular, but the housing 502 may have any suitable shape including polygonal, oval, etc. The housing 502 is preferably made of a material suitable for use with molten aluminum, magnesium, and alloys containing aluminum and magnesium. However, the dual action valve 500 is intended to be used with most types of molten metals, including ferrous-containing molten metals, and the various materials identified in this disclosure in connection with the dual action valve 500 may be changed as necessary to meet specific molten metal requirements. Such changes are well within the skills of those skilled in the art. A presently preferred material for the housing is a high temperature super alloy that has a low oxidation rate and high strength, such as Inconel® 718 which is a steel-nickle alloy having high strength and a low oxidation rate. The housing 502 defines an inlet opening 512 that is used to admit molten metal from an external source, such as the molten metal supply source 132 shown in FIG. 2, into the valve body 504 and ultimately the injector 100.

As indicated previously, the valve body 504 is generally disposed centrally within the housing 502. Preferably, the valve body 504 is a unitary structure made of a material that is suitable for use with molten aluminum, magnesium, and alloys containing these metals. A graphite valve body 504 is preferred because it provides a good shrink-fit into an Inconel® 718 housing 502. The valve body 504 defines an inlet conduit 514 that is in fluid communication with the inlet opening 512. Molten metal from the external source 132 is received into the valve body 504 through the inlet opening 512 and inlet conduit 514. The inlet float member 506 is disposed in the inlet conduit 514 and is adapted to permit molten metal flow through the inlet conduit 514 and prevent reverse molten metal outflow in the inlet conduit 514 and inlet opening 512. Preferably, the inlet float member 506 is spherical (i.e., ball-shaped).

The valve body 504 further defines an outlet conduit 516 that is in fluid communication with the inlet conduit 514 via a molten metal delivery slot 517. The outlet conduit 516 is adapted to dispense molten metal from the valve body 504 to a downstream process or apparatus, such as the outlet manifold 140 shown in FIG. 2. The molten metal delivery slot 517 supplies molten metal to, for example, the injector 100 (see, for example, FIG. 2) in fluid communication with the dual action valve 500, and further serves as an exit conduit for the molten metal discharged from the injector 100 to the outlet conduit 516 during operation of the injector. The primary functions of the molten metal delivery slot 517 are to connect the inlet and outlet conduits 514, 516 and connect the dual action valve 500 to the injector 100 or other apparatus. The outlet conduit 516 includes an outlet chamber 518. The outlet chamber 518 is an enlarged area of the outlet conduit 516 that houses the outlet float assembly 508. The outlet chamber 518 is located downstream of a reduced diameter portion of the outlet conduit 516.

An inlet seat liner 520 is disposed in the inlet conduit 514. In particular, the inlet conduit 514 defines a recessed portion 522 that receives the inlet seat liner 520. Preferably, the inlet seat liner 520 has a tapered outer surface and the recessed portion 522 of the inlet conduit 514 is tapered correspondingly to receive the inlet seat liner 520. The inlet float member 506 coacts with the inlet seat liner 520 to close the inlet conduit 514 upon termination of molten metal flow into the valve body 504, as discussed herein. The inlet seat liner 520 is preferably made of yittria-zirconia, silicone nitride, or another material with similar properties. The foregoing materials are generally suitable for use with molten aluminum, magnesium, and alloys containing aluminum and magnesium. Other equivalent materials may be used for the inlet seat liner 520. Additionally, materials suitable for use with ferrous-containing molten metals, as indicated previously.

As stated, the outlet conduit 516 includes an outlet chamber 518 housing the outlet float assembly 508. The outlet float assembly 508 is preferably comprised of a carrier member 524 and an outlet float member 526 supported by the carrier member 524. The carrier member 524 is configured to receive and support the outlet float member 526 when molten metal is out-flowing from the valve body 504 to a downstream process or apparatus. The outlet float member 526 is preferably removably supported by the carrier member 524. For example, the outlet float member 526 may be removably received in a cup-shaped recess 528 defined in the carrier member 524. Thus, the outlet float member 526 may be spherical shaped to fit within the cup-shaped recess 528. Alternatively, the outlet float member 526 and carrier member 524 may be integrally formed as a one-piece unit, whereby the outlet float member 526 and carrier member 524 are a single unit. The carrier member 524 and outlet float member 526 are preferably made of materials suitable for use with molten aluminum, magnesium, and alloys containing aluminum and magnesium. Suitable materials for the carrier member 524 and outlet float member 526 include graphite and boron nitride. The carrier member 524 and outlet float member 526 may be made of differing materials.

Additionally, the carrier member 524 defines a central passage 530 in fluid communication with the outlet chamber 518 for passage of molten metal through the outlet chamber 518. The carrier member 524 further defines a plurality of branch conduits 532 in fluid communication with the central passage 530 to permit molten metal flow from the outlet chamber 518 to the central passage 530. Further, the carrier member 524 defines a central pressure seal port 534 connecting the central passage 530 and cup-shaped recess 528. The function of the pressure seal port 534 will be discussed further herein. As shown in FIG. 26, the inlet and outlet float members 506, 526 are preferably ball-type float members that are adapted to permit unidirectional flow in their respective conduits (i.e., the inlet conduit 514 and outlet conduit 516).

In a similar manner to the inlet seat liner 520, an outlet seat liner 536 is disposed in a tapered and recessed portion 538 of the outlet conduit 516, upstream of the outlet chamber 518. The outlet float member 526 is adapted to coact with the outlet seat liner 536 to close the outlet conduit 516 upon encountering reverse molten metal flow in the outlet conduit 516 as discussed herein. The outlet seat liner 536 may be made of similar materials discussed previously in connection with the inlet seat liner 520. The outer surface of the outlet seat liner 536 is tapered to cooperate with the tapered and recessed portion 538 of the outlet conduit 516 to ensure proper sealing of the outlet conduit 516 if reverse molten metal flow occurs in the outlet conduit 516. The inlet seat liner 520 and the tapered and recessed portion 522 of the inlet conduit 514 form similar, but oppositely positioned mating surfaces to ensure proper sealing between the inlet float member 506 and inlet seat liner 520 in the event that reverse molten metal flow occurs in the inlet conduit 514 (i.e., in a direction toward the inlet opening 512). The inlet and outlet tapered and recessed portions 522, 538 along with the outer surfaces of the inlet and outlet seat liners 520, 536 are tapered in opposite directions, respectively, to ensure proper sealing when reverse molten metal flow is encountered in either the inlet conduit 514 or outlet conduit 516. The tapering in the inlet and outlet conduits 514, 516 and on the outer surfaces of the inlet and outlet seat liners 520, 536 provide a "wedging" action when the inlet float member 506 coacts with the inlet seat liner 520 and the outlet float assembly 508 coacts with the outlet seat liner 536. For example, in the arrangement shown in FIG. 26, the tapered portion 522 of the inlet conduit 514 is funnel-shaped and narrows in the direction toward the inlet opening 512. Thus, when molten metal is being dispensed from the dual action valve 500, the inlet float member 506 seats against the inlet seat liner 520 causing the inlet seat liner 520 to tightly seal (i.e., "wedge") within the tapered portion 522. The tapered 538 in the outlet conduit 516 is funnel-shaped in the opposite direction (i.e., in the direction away from the outlet float assembly 508) from the tapered portion 522 for a similar reason.

The dual action valve 500 further includes top and bottom ends 540, 542. The housing 502 defines a plurality of seal grooves 544 at the top and bottom ends 540, 542 of the dual action valve 500. The seal grooves 544 are adapted to form a sealing connection with molten metal flow conduits (i.e., tubes, pipes, or injector housing 102 as shown in FIG. 2) or other devices, such as the manifold 140 to be connected to the dual action valve 500. For example, the seal grooves 544 may be used to form a tight sealing connection with a pipe provided at the top end 540 of the dual action valve 500 and the outlet manifold 140 at the bottom end 542 of the dual action valve 500. Preferably, gaskets (not shown), such as a graphite gaskets, are interposed between the housing 502 and the apparatuses connected to the ends 540, 542 of the housing 502. The gaskets form a sealing connection with the seal grooves 544 so that molten metal does not leak at the connections between the housing 502 and the upstream and downstream apparatuses. In the arrangement of FIG. 2, the upstream apparatus is the injector 100 and the downstream apparatus is the outlet manifold 140.

The inlet float member 506 is preferably made of a material having a greater density than the molten metal admitted to the valve body 504. Thus, the inlet float member 506 unseats from the inlet seat liner 520 only under the action of molten metal flow into the valve body 504 through the inlet conduit 514. Once molten metal flow is discontinued, the inlet float member 506 under the influence of gravity will seat against the inlet seat liner 520 and close the inlet conduit 514. Additionally, when molten metal is being dispensed from the dual action valve 500 to the downstream apparatus or process, for example the outlet manifold 140 shown in FIG. 2, the molten metal flow into the molten metal delivery slot 517 and, further, inlet conduit 514 will aid the force of gravity in seating the inlet float member 506 against the inlet seat liner 520. In an analogous manner, the outlet float member 526 may be made of a material having a lower density than the molten metal admitted to the valve body 504. When molten metal is flowing downward in the outlet conduit 516 and into the outlet chamber 518, the molten metal flow and gravity will maintain the outlet float member 526 seated in the cup-shaped recess 528 defined by the carrier member 524. If reverse metal flow is encountered in the outlet chamber 518, the reverse molten metal flow and the lighter density of the outlet float member 526 will cause it to seat against the outlet seat liner 536. This will prevent reverse metal flow in the outlet conduit 516. It will be apparent that system back pressure from the downstream apparatus or process, for example the outlet manifold 140 shown in FIG. 2, will cause reverse molten metal flow into the housing 502 and aid in seating the outlet float member 526 against the outlet seat liner 536.

Alternatively, however, the carrier member 524 and outlet float member 526 forming the outlet float assembly 508 are preferably both configured to move within the outlet chamber 518 to open and close the outlet conduit 516. The carrier member 524 and outlet float member 526 may be made of differing materials as indicated previously. For example, the carrier member 524 may be made of a material having a density less than the molten metal and the outlet float member 526 may be made of a material having a density greater than the molten metal. However, the overall combined density of the outlet float assembly 508 (i.e., carrier member 524 and outlet float member 526) is preferably less than the molten metal admitted to the valve body 504. Thus, when reverse molten metal flow is encountered in the outlet conduit 516 and, in particular, the outlet chamber 518, the outlet float assembly 508 is buoyed up by virtue of its lighter density and the flow of the molten metal, such that the outlet float member 526 seats against the outlet seat liner 536 and prevents reverse molten metal flow in the outlet conduit 516. The pressure seal port 534 defined in the carrier member 524 assists the sealing operation of the outlet float assembly 508 by directing the system pressure force provided by the downstream apparatus or process (i.e., outlet manifold 14) directly against the outlet float member 526. Thus, when the downstream system pressure causes reverse molten metal flow into the housing 502, the pressure force is applied against the carrier member 524 generally, and outlet float member 526 specifically through the pressure seal port 534. The pressure force applied to the outlet float member 526 is typically sufficient to separate it marginally from recess 528, but the upward movement of the carrier member 524 will keep the outlet float member 526 "seated" in recess 528. Preferably, the outlet float member 526 is spherical shaped and cooperates tightly with the spherical or cup-shaped recess 528 in the carrier member 524. The tight connection between the outlet float member 526 and carrier member 524 is sufficient to prevent the outlet float member 526 from disengaging from the cup-shaped recess 528 until system back pressure from the downstream apparatus or process (i.e., outlet manifold 140) is applied to the outlet float member 526 through the pressure seal port 534.

Figure 27:
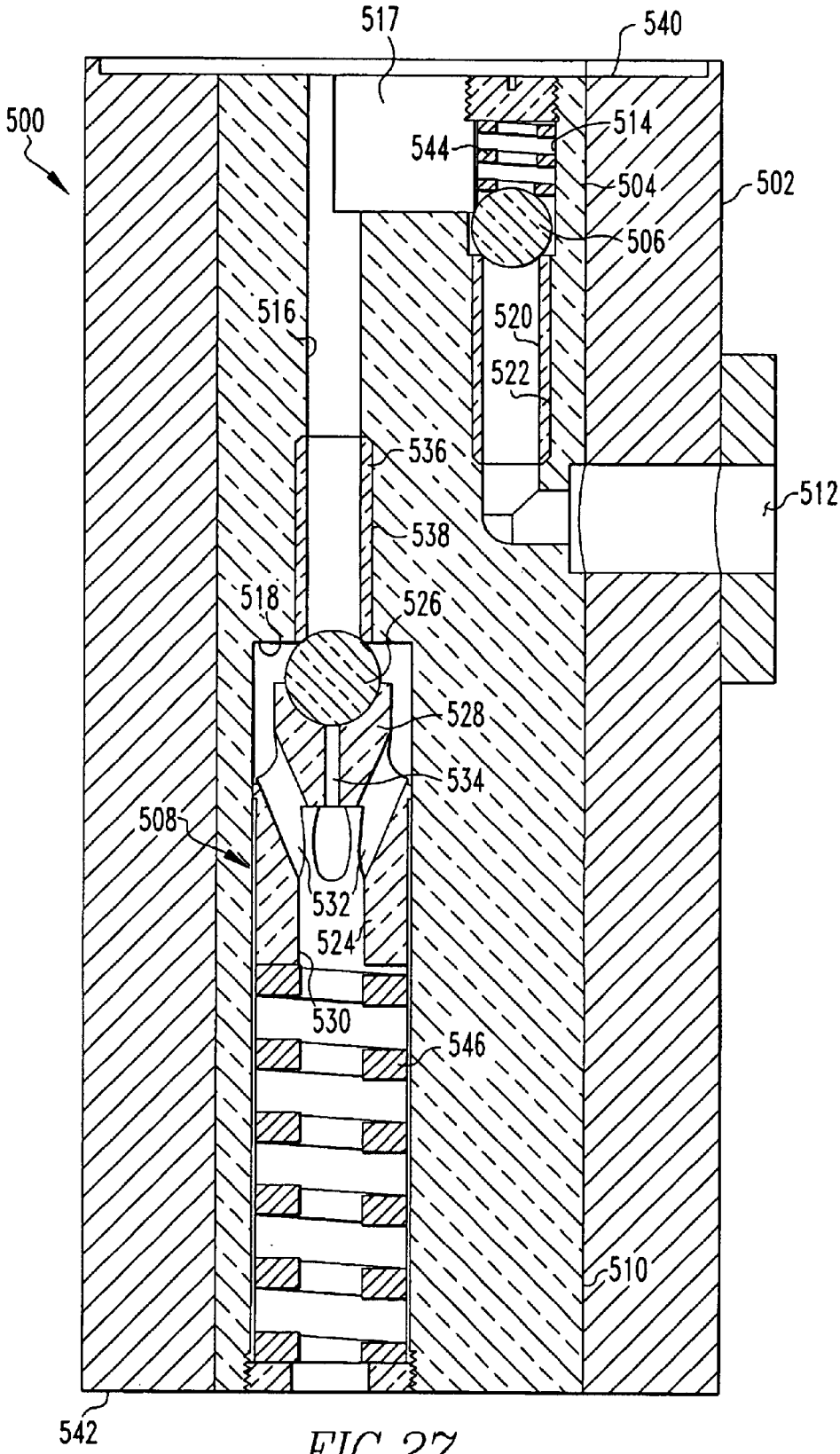
FIG. 27 is a cross sectional view of an alternative embodiment of the dual action valve of FIG. 26 in accordance with the present invention.

In another embodiment of the dual action valve 500 shown in FIG. 27, two spring members 544, 546 are provided in the inlet conduit 514 and outlet conduit 516, respectively. The springs 544, 546 provide additional force for sealing the inlet float member 506 against the inlet seat liner 520 and sealing the outlet float assembly 508 against the outlet seat liner 536. Preferably, however, only the spring member 546 in the outlet conduit 516 is typically required in the dual action valve 500 shown in FIG. 27. This is because the inlet float member 506 is assisted by the force of gravity in closing the inlet conduit 514 to reverse molten metal flow. Gravity-assist is not typically sufficient for the outlet float assembly 508 to seal the outlet conduit 516.

In the arrangement of FIG. 26, as stated previously, the first spring member 544 is provided in the inlet conduit 514 and the second spring member 546 is provided in the outlet chamber 518. The first spring member 544 is disposed in the inlet conduit 514 downstream of the inlet float member 506 and is adapted to coact with the inlet float member 506 to assist in closing the inlet conduit 514 upon termination of molten metal flow into the valve body 504 through the inlet opening 512 in the housing 502. Similarly, the second spring member 546 is located in the outlet chamber 518 downstream of, but in contact with, the carrier member 524. The second spring member 546 is configured to assist the outlet float assembly 508 in closing the outlet conduit 516 if reverse molten metal flow occurs in the outlet conduit 516, and help to counteract the force of gravity. The spring members 544, 546 may be made of a ceramic or metallic material, preferably one suitable for use with molten aluminum and/or magnesium. A presently preferred metallic material is niobium wire. If the orientation of the dual action valve 500 in FIG. 27 is turned upside down, it will be appreciated by those skilled in the art that only the spring member 544 in the inlet conduit 514 would preferably be required to help counteract the force of gravity. However, the use of two spring members 544, 546 ensures good seals in both the inlet conduit 514 and the outlet conduit 514, 516.

In general, the dual action valve 500 of the present invention permits molten metal to alternately be received into the valve body 504 and dispensed therefrom. Once molten metal enters the valve body 504, the inlet float member 506 prevents backflow of molten metal to the molten metal supply source 132. Similarly, the outlet float assembly 508 permits molten metal to be dispensed from the valve body 504 to a downstream process or apparatus, such as the manifold 140 (FIG. 2), but prevents reverse molten metal flow from the downstream process or apparatus from re-entering the valve body 504 and, in particular, the outlet conduit 516.

Figure 28A:
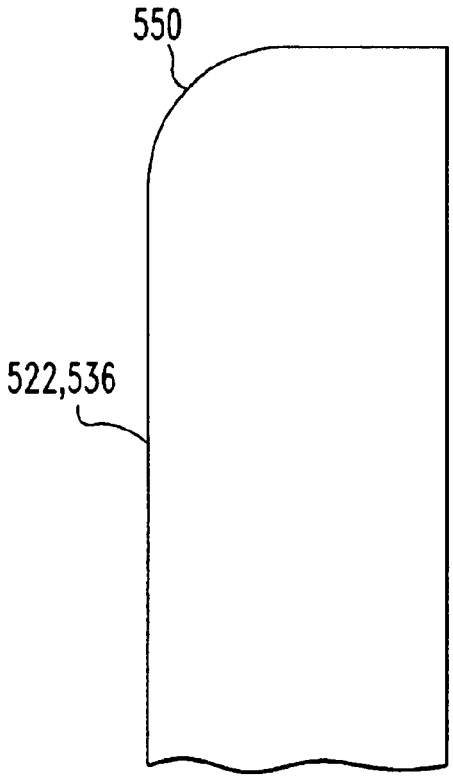
FIG. 28*a* and FIG. 28*b* are schematic detail views showing contact configurations for inlet and outlet seat liners used in the dual action valve in accordance with the present invention.
Figure 28B:
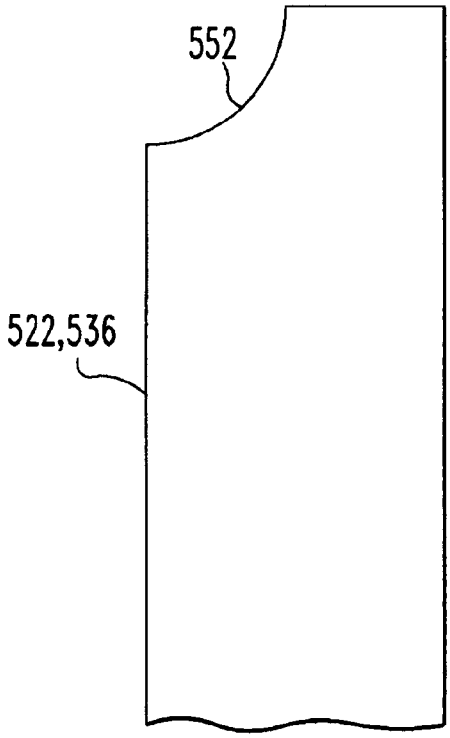

Referring to FIGS. 28*a* and 28*b*, the inlet and outlet seat liners 522, 536 are preferably formed with a curved shaped at the contact region where the inlet and outlet float members 506, 526 engage the inlet and outlet seat liners 522, 536, respectively. FIG. 28*a* and FIG. 28*b* show two preferred contact region shapes 550, 552 for the inlet and outlet seat liners 522, 536. In FIG. 28*a*, contact region 550 is convex and in FIG. 28*b* contact region 552 is concave. Either configuration may be formed into the inlet and outlet seat liners 522, 526 in accordance with the present invention. The respective convex/concave contact regions 550, 552 reduce stress concentration and increase the life of the inlet and outlet seat liners 522, 526 as well as reducing the propensity of the seat liners 522, 526 to wear, erode, and fail.

While preferred embodiments of the present invention were described herein, various modifications and alterations of the present invention may be made without departing from the spirit and scope of the present invention. The scope of the present invention is defined in the appended claims and equivalents thereto.

We claim:

1. A dual action valve for molten metal applications, comprising:

a housing defining an inlet opening;

a valve body disposed within the housing, the valve body defining an inlet conduit in fluid communication with the inlet opening for receiving molten metal into the valve body and an outlet conduit for dispensing molten metal from the valve body;

an inlet float member disposed in the inlet conduit and movable with molten metal flow into the valve body to open the inlet conduit, the inlet float member adapted to close the inlet conduit upon termination of molten metal flow into the valve body; and an outlet float assembly disposed in the outlet conduit and movable with molten metal flow in the outlet conduit to permit molten metal outflow from the valve body and prevent reverse molten metal flow in the outlet conduit.

2. The dual action valve of claim 1 further comprising an inlet seat liner disposed in the inlet conduit, the inlet float member coacting with the inlet seat liner to close the inlet conduit upon termination of molten metal flow into the valve body.

3. The dual action valve of claim 2 wherein the inlet seat liner comprises a tapered outer surface cooperating with a tapered recessed portion of the inlet conduit.

4. The dual action valve of claim 1 wherein the inlet float member has a greater density than the molten metal admitted to the valve body, such that the inlet float member closes the inlet conduit under the force of gravity upon termination of molten metal flow into the valve body.

5. The dual action valve of claim 1 wherein the inlet float member is spherical shaped.

6. The dual action valve of claim 1 wherein the outlet float assembly comprises a carrier member and an outlet float member supported by the carrier member, the outlet float member having a lower density than the molten metal admitted to the valve body, such that the outlet float member is buoyed up from the carrier member to close the outlet conduit if reverse molten metal flow occurs in the outlet conduit.

7. The dual action valve of claim 6 wherein the outlet float member is spherical shaped.

8. The dual action valve of claim 1 wherein the outlet float assembly comprises a carrier member and an outlet float member supported by the carrier member, the carrier member and outlet float member having a combined density lower than the molten metal admitted to the valve body, such that the carrier member and outlet float member are buoyed up to close the outlet conduit if reverse molten metal flow occurs in the outlet conduit.

9. The dual action valve of claim 8 wherein the carrier member and outlet float member are formed integrally as a one-piece unit.

10. The dual action valve of claim 8 wherein the outlet float member is spherical shaped.

11. The dual action valve of claim 8 wherein the outlet float member is removably supported by the carrier member.

12. The dual action valve of claim 8 wherein the outlet float member is removably received in a cup-shaped recess defined in the carrier member.

13. The dual action valve of claim 12 wherein the outlet float member and the cup-shaped recess have mating spherical shapes.

14. The dual action valve of claim 8 wherein the outlet conduit defines an outlet chamber, and the carrier member and outlet float member are disposed in the outlet chamber.

15. The dual action valve of claim 14 wherein the carrier member defines a central passage in fluid communication with the outlet chamber for passage of molten metal through the outlet chamber.

16. The dual action valve of claim 15 wherein the carrier member further defines a plurality of branch conduits connecting the central passage to the outlet chamber.

17. The dual action valve of claim 15 wherein the outlet float member is removably received in a cup-shaped recess defined in the carrier member, and wherein the carrier member further defines a pressure seal port connecting the cup-shaped recess and central passage for molten metal fluid communication therebetween.

18. The dual action valve of claim 14 further comprising an outlet seat liner disposed in the outlet conduit immediately upstream of the outlet chamber, the outlet float member coacting with the outlet seat liner to close the outlet conduit upon reverse molten metal flow in the outlet chamber.

19. The dual action valve of claim 18 wherein the outlet seat liner comprises a tapered outer surface cooperating with a tapered recessed portion of the outlet conduit.

20. The dual action valve of claim 8 further comprising an outlet seat liner disposed in the outlet conduit, the outlet float member coacting with the outlet seat liner to close the outlet conduit upon reverse molten metal flow in the outlet chamber.

21. The dual action valve of claim 20 wherein the outlet seat liner comprises a tapered outer surface cooperating with a tapered recessed portion of the outlet conduit.

22. The dual action valve of claim 1 wherein the housing has a top end and a bottom end, and wherein the top and bottom ends each define circumferential seal grooves for creating seals with molten metal flow conduits to be connected to the top and bottom ends of the housing.

23. The dual action valve of claim 1 further comprising a spring member disposed in the inlet conduit downstream of the inlet float member and coacting with the inlet float member to assist in closing the inlet conduit upon termination of molten metal flow into the valve body.

24. The dual action valve of claim 1 further comprising a spring member disposed in the inlet conduit downstream of the inlet float member and coacting with the inlet float member to assist in closing the inlet conduit upon termination of molten metal flow into the valve body, and wherein the outlet float assembly further comprises an additional spring member coacting with the carrier member to assist in closing the outlet conduit if reverse molten metal flow occurs in the outlet conduit.

25. A dual action valve for molten metal applications, comprising:

a housing defining an inlet opening;

a valve body disposed within the housing, the valve body defining an inlet conduit in fluid communication with the inlet opening for receiving molten metal into the valve body and an outlet conduit for dispensing molten metal from the valve body;

an inlet float member disposed in the inlet conduit and movable with molten metal flow into the valve body to open the inlet conduit; and an outlet float assembly disposed in the outlet conduit and movable with molten metal flow in the outlet conduit to permit molten metal outflow from the valve body, the outlet float assembly comprising a carrier member, an outlet float member supported by the carrier member, and a spring member coacting with the carrier member, the carrier member and spring member adapted to close the outlet conduit and prevent reverse molten metal flow in the outlet conduit.

26. The dual action valve of claim 25 further comprising an inlet seat liner disposed in the inlet conduit, the inlet float member coacting with the inlet seat liner to close the inlet conduit upon termination of molten metal flow into the valve body.

27. The dual action valve of claim 26 wherein the inlet seat liner comprises a tapered outer surface cooperating with a tapered recessed portion of the inlet conduit.

28. The dual action valve of claim 25 wherein the inlet float member has a greater density than the molten metal admitted to the valve body, such that the inlet float member closes the inlet conduit under the force of gravity upon termination of molten metal flow into the valve body.

29. The dual action valve of claim 25 wherein the inlet float member is spherical shaped.

30. The dual action valve of claim 25 wherein the carrier member and outlet float member having a combined density lower than the molten metal admitted to the valve body, such that the carrier member and outlet float member are buoyed up to close the outlet conduit if reverse molten metal flow occurs in the outlet conduit.

31. The dual action valve of claim 30 wherein the outlet float member is spherical shaped.

32. The dual action valve of claim 25 wherein the outlet float member is removably received in a cup-shaped recess defined in the carrier member.

33. The dual action valve of claim 32 wherein the outlet float member and the cup-shaped recess have mating spherical shapes.

34. The dual action valve of claim 25 wherein the outlet conduit defines an outlet chamber, and the outlet float assembly is disposed in the outlet chamber.

35. The dual action valve of claim 34 wherein the carrier member defines a central passage in fluid communication with the outlet chamber for passage of molten metal through the outlet chamber.

36. The dual action valve of claim 35 wherein the carrier member further defines a plurality of branch conduits connecting the central passage to the outlet chamber.

37. The dual action valve of claim 35 wherein the outlet float member is removably received in a cup-shaped recess defined in the carrier member, and wherein the carrier member further defines a pressure seal port connecting the cup-shaped recess and central passage for molten metal fluid communication therebetween.

38. The dual action valve of claim 34 further comprising an outlet seat liner disposed in the outlet conduit immediately upstream of the outlet chamber, the outlet float member coacting with the outlet seat liner to close the outlet conduit upon reverse molten metal flow in the outlet chamber.

39. The dual action valve of claim 38 wherein the outlet seat liner comprises a tapered outer surface cooperating with a tapered recessed portion of the outlet conduit.

40. The dual action valve of claim 25 wherein the housing has a top end and a bottom end, and wherein the top and bottom ends each define circumferential seal grooves for creating seals with molten metal flow conduits to be connected to the top and bottom ends of the housing.

* * * * *